US006543821B1

(12) United States Patent
Weinerman et al.

(10) Patent No.: US 6,543,821 B1
(45) Date of Patent: Apr. 8, 2003

(54) SLAM CAPABLE LATCH AND LOCK SYSTEM

(75) Inventors: Lee S. Weinerman, Medina, OH (US); Scott A. Arthurs, Brunswick, OH (US)

(73) Assignee: The Eastern Company, Cleveland, OH (US)

( * ) Notice: Subject to any disclaimer, the term of this patent is extended or adjusted under 35 U.S.C. 154(b) by 0 days.

(21) Appl. No.: 10/034,690

(22) Filed: Dec. 27, 2001

Related U.S. Application Data

(60) Provisional application No. 60/286,470, filed on Apr. 25, 2001.

(51) Int. Cl.[7] ..... E05C 19/10

(52) U.S. Cl. ..... 292/123; 292/26; 70/208

(58) Field of Search ..... 292/26, 25, 48, 292/123, 97, 223; 70/208–211

(56) References Cited

U.S. PATENT DOCUMENTS

| | | | | |
|---|---|---|---|---|
| 417,589 A | | 12/1889 | Rose | 292/40 |
| 491,824 A | | 2/1893 | Walker | 200/61.64 |
| 767,567 A | | 8/1904 | Keil | 292/127 |
| 876,300 A | | 1/1908 | Couret | 292/135 |
| 925,455 A | | 6/1909 | Campbell | 70/81 |
| 1,058,346 A | | 4/1913 | Berstler | 292/21 |
| 1,531,605 A | | 3/1925 | Gaynor | 200/535 |
| 1,556,864 A | | 10/1925 | Mendenhall | 292/33 |
| 1,571,453 A | | 2/1926 | Maxon | 292/170 |
| 1,672,901 A | | 6/1928 | North | 292/227 |
| 1,965,939 A | | 7/1934 | Jacobi | 70/29 |
| 2,059,479 A | | 11/1936 | North | 292/127 |
| 2,143,965 A | * | 1/1939 | Voorhees | 70/153 |
| 2,705,884 A | | 4/1955 | Craig | 70/264 |
| 2,728,214 A | | 12/1955 | Craig | 70/149 |
| 2,755,519 A | | 7/1956 | Yander | 20/52 |
| 2,772,908 A | | 12/1956 | Craig | 292/280 |
| 2,911,247 A | | 11/1959 | Corbin | 292/48 |
| 2,987,907 A | | 6/1961 | Cockburn et al. | 70/135 |
| 3,054,634 A | | 9/1962 | Westerdale | 292/336.3 |
| 3,602,017 A | | 8/1971 | Bauer | 70/78 |
| 3,964,280 A | | 6/1976 | Kelton | 70/84 |
| 4,059,296 A | | 11/1977 | Panourgias | 285/312 |
| 4,488,669 A | | 12/1984 | Waters | 224/273 |
| 4,978,152 A | | 12/1990 | Bisbing | 292/169 |
| D313,337 S | | 1/1991 | Haskell | D8/336 |
| 5,042,853 A | | 8/1991 | Gleason et al. | 292/126 |
| D324,635 S | | 3/1992 | Weinerman et al. | D8/331 |
| 5,308,126 A | | 5/1994 | Weger, Jr. et al. | 292/53 |
| 5,346,266 A | | 9/1994 | Bisbing | 292/64 |
| 5,439,260 A | | 8/1995 | Weinerman et al. | 292/48 |
| 5,526,660 A | | 6/1996 | Bennett et al. | 70/208 |

(List continued on next page.)

FOREIGN PATENT DOCUMENTS

JP 6-336871 * 6/1994 ..... E05C/1/16

OTHER PUBLICATIONS

Tri/Mark, New Hampton, IA "40–400 Push Button Center Control" 2–Page Brochure Dated 1/98.

*Primary Examiner*—Gary Estremsky
(74) *Attorney, Agent, or Firm*—David A. Burge

(57) ABSTRACT

A versatile slam capable latch mechanism that can be operated by one or more adjacent and/or remotely located operating devices to release a striker from latched engagement; that can be directly attached to an operating device such as a flush-mountable paddle handle assembly to provide a "stand alone" latch; that can be connected by one or more rod-like links to one or more remotely located operating devices such as push button assemblies; that can be connected by rod-like links to other similar latch mechanisms each arranged to be slammed into engagement with a different striker to provide a "plural point" latching system; and wherein one of the various types of operating devices that may be connected to a latch system that includes one or more of the latch mechanisms can be provided with a key operated lock to "lock" the system.

41 Claims, 13 Drawing Sheets

U.S. PATENT DOCUMENTS

| | | | | |
|---|---|---|---|---|
| D371,300 | S | | 7/1996 | Mordick ..... D8/343 |
| 5,564,295 | A | | 10/1996 | Weinerman et al. ..... 70/208 |
| 5,586,458 | A | | 12/1996 | Weinerman et al. ..... 70/208 |
| 5,611,224 | A | | 3/1997 | Weinerman et al. ..... 70/208 |
| 5,816,630 | A | | 10/1998 | Bennett et al. ..... 292/341.17 |
| 5,820,174 | A | * | 10/1998 | Parikh ..... 292/126 |
| 5,884,948 | A | * | 3/1999 | Weinerman ..... 292/216 |
| 5,984,383 | A | | 11/1999 | Parikh et al. ..... 292/121 |
| 6,012,747 | A | | 1/2000 | Takamura et al. ..... 292/216 |
| D429,141 | S | | 8/2000 | Antonucci et al. ..... D8/331 |
| 6,113,160 | A | | 9/2000 | Johansson et al. ..... 292/169 |
| D432,389 | S | | 10/2000 | Johansson et al. ..... D8/331 |
| 6,231,091 | B1 | | 5/2001 | Gleason et al. ..... 292/34 |
| D447,042 | S | | 8/2001 | Weinerman et al. ..... D8/330 |
| 6,349,577 | B1 | | 2/2002 | Hansen et al. ..... 70/159 |
| 6,454,321 | B1 | | 9/2002 | Parikh ..... 292/216 |

* cited by examiner

SLAM CAPABLE LATCH AND LOCK SYSTEM

REFERENCE TO PROVISIONAL APPLICATION

This application claims the benefit of U.S. provisional application Serial No. 60/286,470 entitled SLAM CAPABLE LATCH AND LOCK SYSTEM filed Apr. 25, 2001 by Lee S. Weinerman et al, the disclosure of which is incorporated herein by reference.

REFERENCE TO PENDING UTILITY APPLICATION

Reference is made to a pending utility application Serial No. 06/698,416 entitled PUSH BUTTON OPERATORS FOR LATCHES AND LOCKS, AND LOCKING SYSTEMS EMPLOYING LOCKABLE PUSH BUTTON OPERATORS filed Oct. 27, 2000 by Lee S. Weinerman et al, which discloses a plural-point tool box locking system that employs a set of rod-like links that interconnect a spaced array of slam-capable latch assemblies that can be operated by either of a pair of remotely located push-button operating devices, referred to hereinafter as the "Push Button Lock System Case," the disclosure of which is incorporated herein by reference.

BACKGROUND OF THE INVENTION

1. Field of the Invention

The present invention relates to a highly versatile slam capable latch mechanism that can be operated by one or more adjacent and/or remotely located operating devices to release a striker that is engaged by the latch mechanism when latched; that can be directly attached to an operating device such as a paddle handle carried in a flush mountable, pan shaped housing to provide a "stand alone" latch assembly for receiving and releasably retaining a single striker; that can be connected by one or more rod-like links to one or more remotely located operating devices such as push button assemblies (for example, the push button assemblies that are disclosed in the referenced Push Button Lock System Case); that can be connected by rod-like links to other similar latch mechanisms each arranged to receive and releasably retain a separate striker to provide a slammable "plural point" latching system; and wherein a selected one of the various types of operating devices that may be connected to a latch system that includes one or more of the latch mechanisms can be provided with a key operated lock to "lock" the system so as to disable all of the operating devices of the system from unlatching all of the latch mechanisms of the system, with the "locking" of the system doing nothing to defeat the ability of the latch mechanisms of the system to be slammed into retaining engagement with their associated strikers.

In one typical use, one or more of the slam capable latch mechanisms are mounted on the side or end walls of a tool box for releasably retaining a corresponding number of lid-mounted strikers (each associated with a different one of the latch mechanisms) that may be slammed into engagement with the latch mechanisms by closing the lid, wherein one or more operating devices are provided for operating the latch mechanisms, with spaced ones of the latch mechanisms and operating devices being connected by linkage that enables each of the operating devices to unlatch all of the latch mechanisms from their associated strikers, and with a key operated lock preferably being connected to a selected one of the operating devices that, when locked, will serve to prevent all of the operating devices from operating any of the latch mechanisms without defeating the capability of any of the latch mechanisms to be slammed into retaining engagement with their associated strikers when the lid of the tool box is closed.

2. Prior Art

Latch mechanisms are known that define openings or receiving channels adapted to receive suitably configured strikers that are releasably retained in the openings or channels by hook-shaped arms that pivot to grasp the strikers as they enter the openings or receiving channels. It also is known to attach latch mechanisms of this type to operating devices that include flush mountable, pan shaped housings that nest operating handles that can be moved from non-operated to operated positions to operate (i.e., to "unlatch") the latch mechanisms. Latch mechanisms of this type connected to operating devices of this type are disclosed in U.S. Pat. Nos. 5,984,383 and 5,042,853, the disclosures of which are incorporated herein by reference.

Moreover, it is known to utilize rod-like links to interconnect two or more of the latch mechanisms of the general type described above to provide a plural-point latch system wherein each of the latch mechanisms is associated with and adapted to receive and releasably retain a separate striker, and wherein one or more remotely located operating devices such as push button assemblies are provided to concurrently operate (i.e., to concurrently "unlatch") all of the linkage connected latch mechanisms from their associated strikers. Latch systems of this type are disclosed in U.S. Pat. Nos. 5,816,630 and 5,308,126, the disclosures of which are incorporated herein by reference, and in the referenced Push Button Lock System Case.

SUMMARY OF THE INVENTION

The present invention provides a slam capable latch mechanism that can be operated by one or more adjacent and/or remotely located operating devices to release a striker from latched engagement; that can be directly attached to an operating device such as a flush-mountable paddle handle assembly to provide a "stand alone" latch; that can be connected by one or more rod-like links to one or more remotely located operating devices such as push button assemblies; that can be connected by rod-like links to other similar latch mechanisms each arranged to be slammed into engagement with a different striker to provide a "plural point" latching system.

Where features of the present invention are combined to provide a locking system, at least one of the various types of operating devices that may be connected to the system for operating one or a plurality of latch mechanisms is provided with a key operated lock to permit the system to be locked and unlocked for operation.

One aspect of the invention relates to the provision of an improved latch assembly that can be remotely operated, or that can be attached to an operating assembly such as a flush-mountable housing and handle assembly. The latch assembly preferably includes a frame formed as a one-piece stamping from sheet metal and having a relatively flat base portion that extends within a first plane, and having a pair of formations that extend away from the base portion in a plane that substantially parallels the first plane to define first and second arms that define a striker receiving channel between opposed portions of the first and second arms. The latch assembly also includes means for defining a generally cylindrical mounting pin that is connected to and extends away from the flat base portion along an axis that is substantially perpendicular to the first plane; an operating arm formed as a one-piece stamping from sheet metal and having a relatively flat central region positioned to closely overlie the relatively flat base portion of the frame, with a hole being formed through the relatively flat central region through which the mounting pin extends to connect the operating arm and the frame for relative pivotal movement about said axis; means for defining a limited range of permitted relative pivotal movement that can take place between the operating arm and the frame including first and second spaced-apart stop formations defined by a selected one of the frame and the operating arm, and a stop engageable formation defined by the other of the frame and the operating arm that is configured to engage the first stop formation at one end of said range of movement, and to engage the second stop formation at the other end of said range of movement; a latch arm formed as a one-piece stamping from sheet metal and having a relatively flat portion positioned to closely overlie the relatively flat central region of the operating arm, with a hole being formed through the relatively flat portion through which the mounting pin extends to connect the latch arm and the frame for relative pivotal movement about said axis, with the latch arm defining a hook-shaped formation at a location spaced from said axis, with the hook-shaped formation having a first surface configured to be engaged by a striker that is moving along a path of travel into the striker receiving channel to cause pivotal movement of the latch arm in one direction of rotation about said axis to pivot the hook-shaped formation out of said path of travel, and with the hook-shaped formation also having a second surface configured to retain the striker within the striker receiving channel once the hook-shaped formation has pivoted in a direction of rotation opposite to said one direction to position the second surface to block withdrawal of the striker from the channel; means for permitting the latch arm to move in said one direction of rotation without causing corresponding pivotal movement of the operating arm in said one direction to thereby enable a striker to be moved rapidly into the striker receiving channel and into latched engagement with the latch assembly without causing pivotal movement of the operating arm if the striker engages the first surface and thereby causes the latch arm to pivot out of the path of travel followed by the striker in moving into the striker receiving channel; biasing means for biasing the latch arm to apply torque thereto for pivoting the latch arm in said opposite direction of rotation, and for utilizing the lost motion connection means to transfer from the latch arm to the operating arm said torque applied by the biasing means to pivot the operating arm in said opposite direction and to thereby bias the stop engageable formation toward engagement with the second stop formation; and, means for defining on the operating arm at a location spaced from said axis at least one connection formation for receiving an application of torque to the operating arm for rotating the operating arm in said one direction of rotation to drive the latch arm in said one direction of rotation to pivot the hook-shaped formation of the latch arm to position the second surface so that it does not block withdrawal of the striker from the striker receiving channel to thereby unlatch the latch mechanism from retainingly engaging the striker.

BRIEF DESCRIPTION OF THE DRAWINGS

These and other features, and a fuller understanding of the invention may be had by referring to the following description and claims, taken in conjunction with the accompanying drawings, wherein:

DESCRIPTION OF INVENTION EMBODIMENTS

Figure 1:
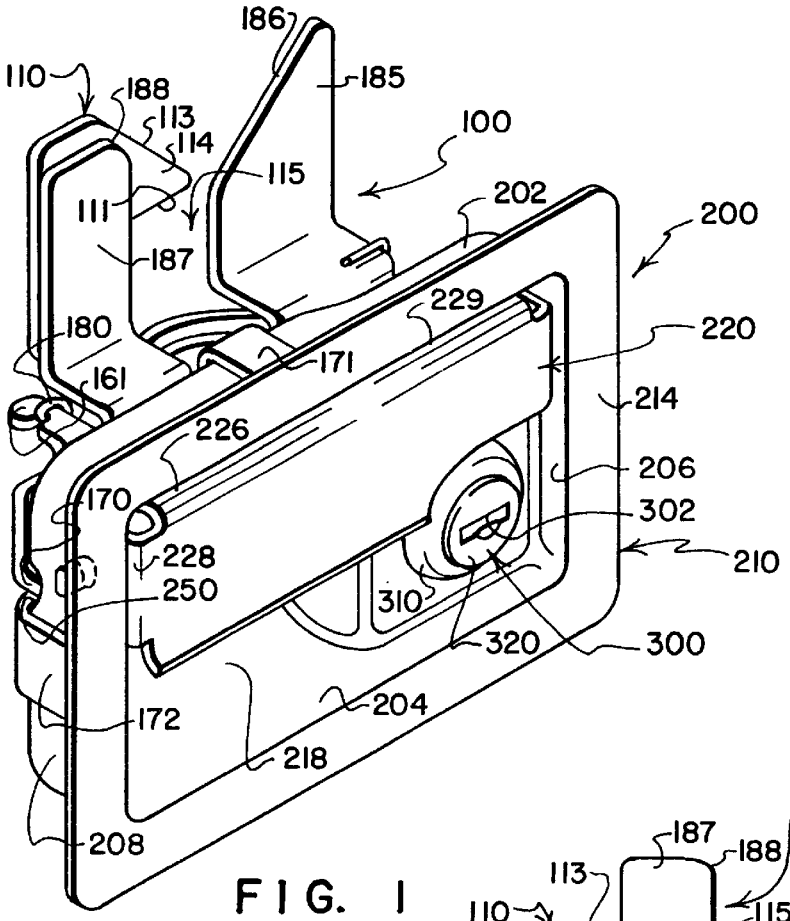
FIG. 1 is a perspective view of the versatile latch mechanism of the present invention attached to a paddle handle operating device to provide a stand-alone latch assembly, with a paddle handle of the operating device depicted in a nested, non-operated position, with a hook-shaped latch arm of the latch mechanism shown in a normal non-operated position, and with a keyway of the a key-operated lock shown in a "locked" orientation.
Figure 3:
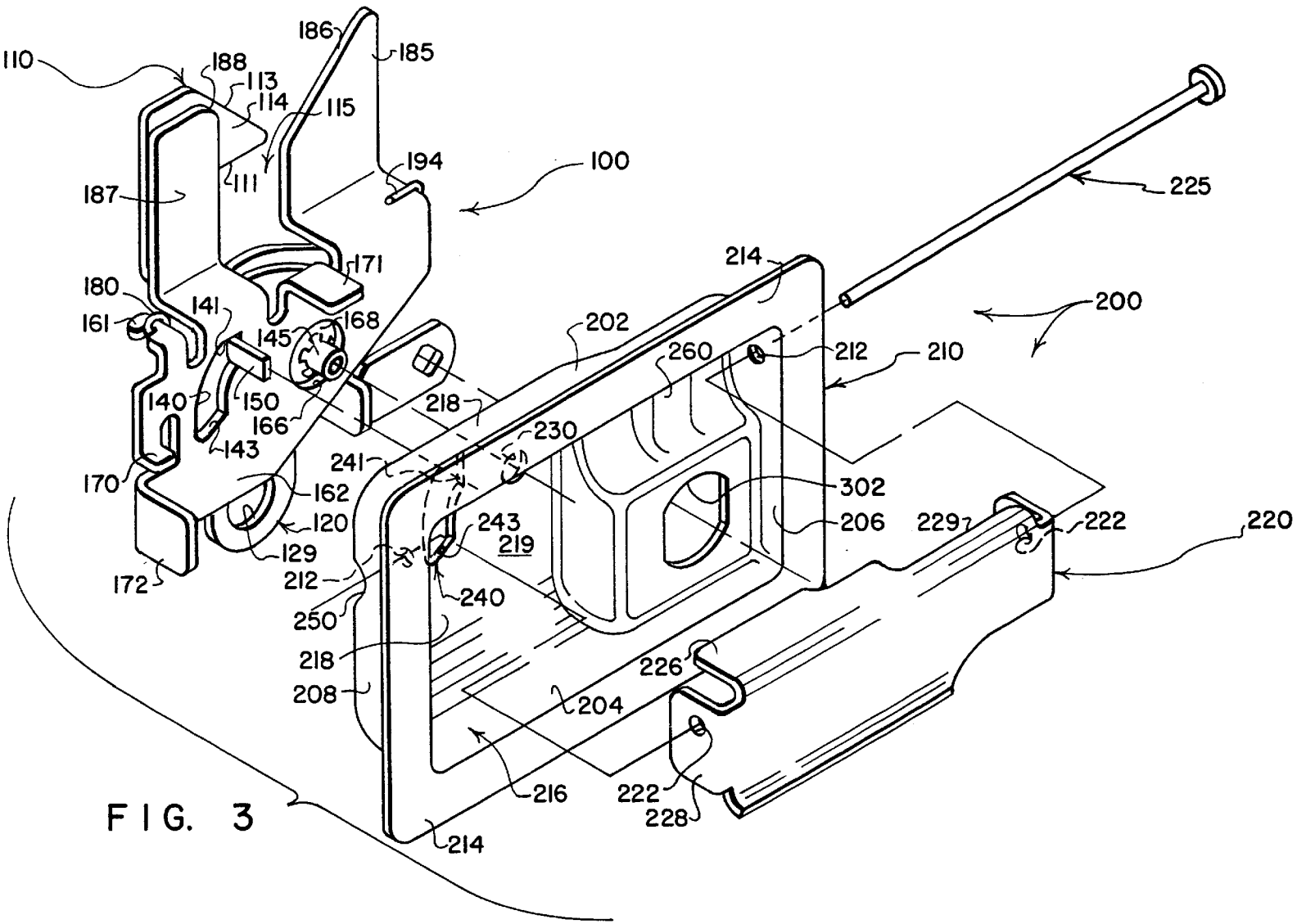
FIG. 3 is an exploded perspective view of the stand-alone latch assembly of FIG. 1 showing the latch mechanism separated from selected components of the paddle handle operating device.

Referring to FIGS. 1 and 3, a latch mechanism that embodies features of the present invention is indicated generally by the numeral 100. An operating device for operating the latch mechanism 100 (i.e., for releasing or "unlatching" the latch mechanism 100 from engagement with a suitably configured striker) is indicated generally by the numeral 200. When assembled, as depicted in FIG. 1, the latch mechanism 100 and the operating device 200 form a latch assembly that can be used in a stand-alone manner to engage a single striker to perform lid-latching or closure fastening functions or the like; and that can be used in a latching system with other similar latch mechanisms and/or with other similar latch assemblies and/or with other operating devices, as is illustrated by the latching system embodiments of FIGS. 14–16 and FIGS. 17–19.

Referring to FIG. 3, the operating device 200 includes a flush mountable, pan shaped housing 210 of generally rectangular shape. The housing 210 has a perimetrically extending rim 214 that surrounds a forwardly facing recess 216. The recess 216 is surrounded by opposed side walls 202, 204 and opposed end walls 206, 208 that are joined at the rear of the recess 216 by a back wall 218. A major portion 219 of the back wall 218 is flat. A paddle type operating handle 220 is shown in its normal non-operated position nested in the recess 216 in FIG. 1, and is shown in its operated position extending from the recess 216 in FIG. 2.

Figure 4:
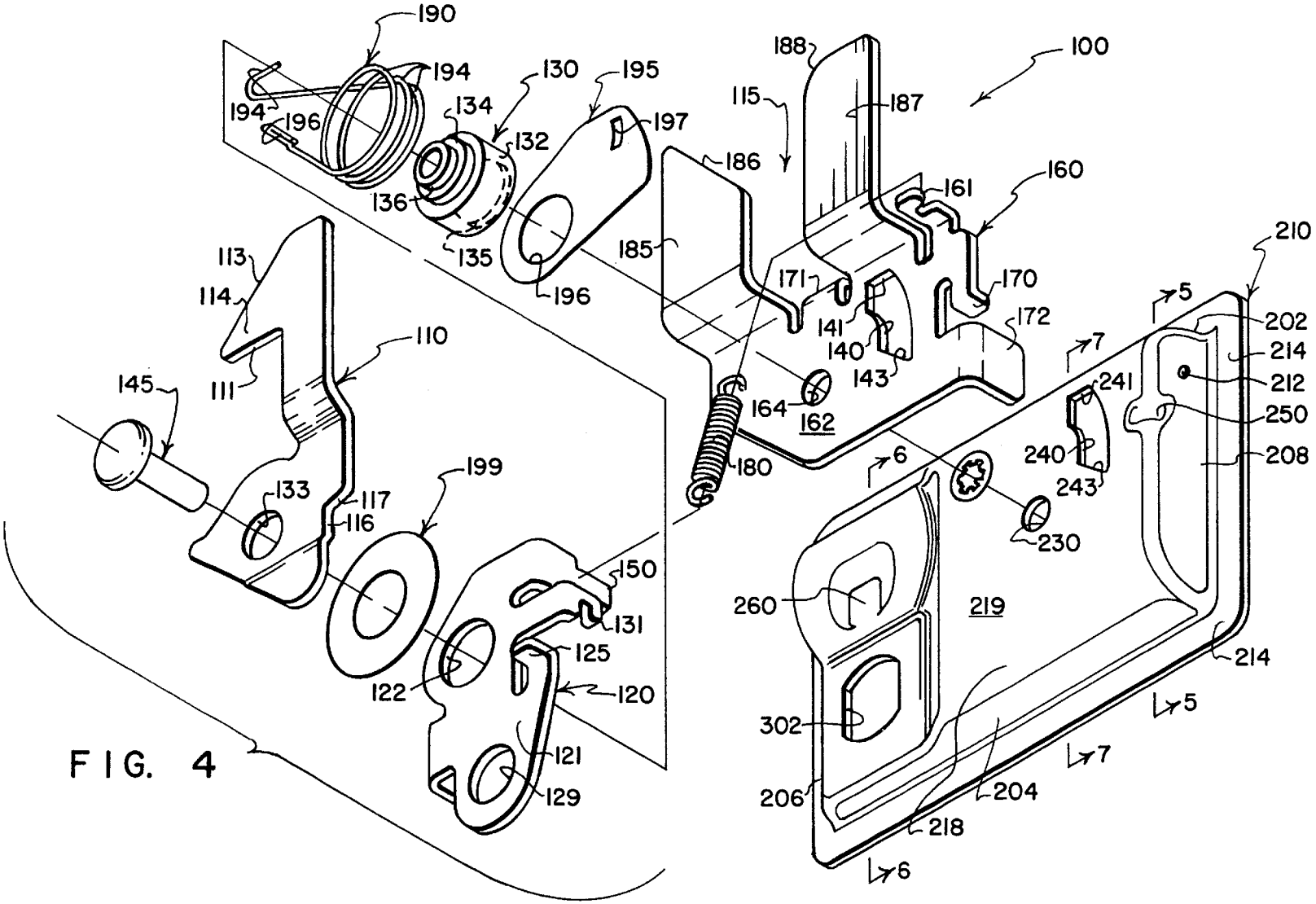
FIG. 4 is an exploded perspective view showing components of the latch mechanism and selected components of the paddle handle operating device.

Referring to FIGS. 3 and 4, the flat portion 219 of the back wall 218 of the housing 210 is provided with a centrally located hole 230 (which is utilized in attaching the housing 210 to the latch mechanism 100, as will be explained), and with a curved slot 240 (through which an operating projection 150 of the latch mechanism 100 extends so as to be drivingly engaged by a rearwardly extending portion 226 of the handle 220 to operate the latch mechanism 100 in response to movement of the handle 220 from its non-operated position to its operated position, as will be explained). The slot has an "outer" end region 241 located near the side wall 202 and an "inner" end region 243 located nearer to a central region of the recess 216.

Figure 5:
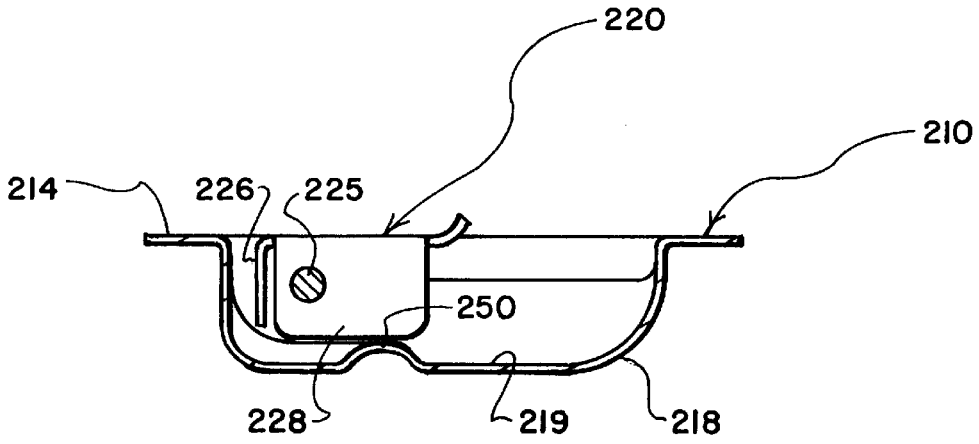
FIG. 5 is a sectional view as seen generally from a plane indicated by a line 5—5 in FIG. 4, with the handle of the latch operating device shown in its normal, nested, non-operated position.
Figure 6:
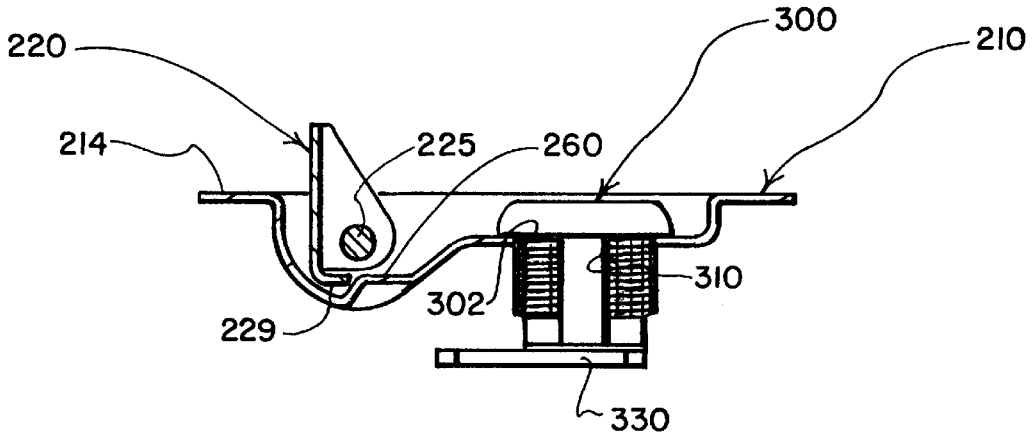
FIG. 6 is a sectional view as seen generally from a plane indicated by a line 6—6 in FIG. 4, with the handle of the latch operating device shown in its extended, operated position.

Referring to FIGS. 3, 5 and 6, the back wall 218 of the housing 210 is provided with stamped formations 250, 260 that may be configured to engage portions of the paddle handle 220 to "stop" the travel of the pivotal movement of the handle 220 at opposite ends of its range of motion. In FIG. 5, it will be seen that the stop formation 250 is engaged by an end wall 228 of the handle 220 when the handle 220 is in its normal, nested, non-operated position. In FIG. 6, it will be seen that the stop formation 260 may be configured to engage a rearward portion 229 of the handle 220 when the handle 220 is in its extended or operated position (as depicted in FIG. 2).

Figure 7:
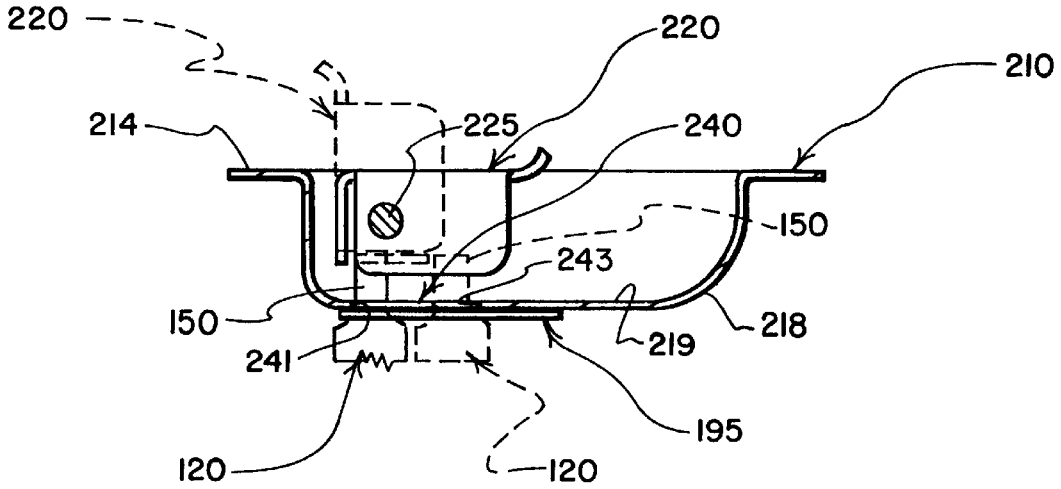
FIG. 7 is a sectional view as seen generally from a plane indicated by a line 7—7 in FIG. 4, with the handle of the latch operating device and portions of an operating arm of the latch mechanism shown in solid lines in their normal non-operated positions, and in dotted lines in their operated positions.

Referring to FIGS. 3 and 7, it will be seen that the operating projection 150 of the latch mechanism 100 extends through the curved slot 240. The projection 150 is biased (by a spring 180 of the latch mechanism 100, as will be explained shortly) toward the outer end region 241 of the slot 240; and, inasmuch as the projection 150 engages the rear handle portion 226, the operation of the coiled tension spring 180 also serves to bias the handle 220 toward its nested non-operated position. However, when the handle 220 is pivoted toward its operated position (as shown in dotted lines in FIG. 7), the rear portion 226 of the handle 220 moves the operating projection 150 to the opposite or inner end region 243 of the slot 240 to a position where the projection 150 engages the inner end region 243 of the slot 240 so as to "stop" further rotation of the handle 220. Thus, the engagement of the handle portion 226 with the projection 150 and the engagement of the projection 150 with the inner end region 243 of the slot 240 (as depicted in dotted lines in FIG. 7) may serve to "stop" further rotation of the handle 220 in the event that the rear portion 229 of the handle 220 has not yet come into engagement with the rear wall stop formation 260 (as depicted in dotted lines in FIG. 6); and, the slot ends 214, 243 can serve as "stops" that may be engaged by the operating arm projection 150 to limit the extent of permitted angular movement of the operating arm 120.

Figure 2:
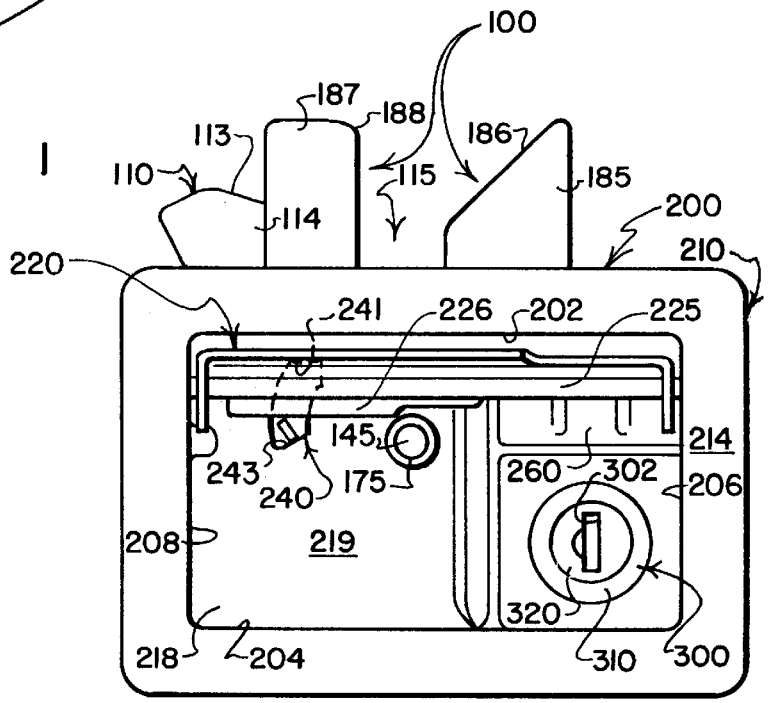
FIG. 2 is a front elevational view thereof but with the paddle handle extended by pivoting it to an operated position, with the hook-shaped latch arm operated by pivoting it to an unlatched position, and with the keyway turned a quarter turn to an "unlocked" orientation.

Referring to FIGS. 1, 2 and 7, a conventional key operated, quarter-turn cam lock 300 can be mounted in a hole 302 (see FIG. 3) formed through the back wall 218 of the housing 210. If no key operated cam lock 300 is to be mounted on the housing 210, no hole 302 is provided through the back wall 218. The key operated cam lock 300 has a keyway 302 that is adapted to receive a suitably configured key (not shown). The lock 300 has internal components that include a housing 310, a plug 320 journaled by the housing for quarter-turn rotation therein in response to turning of a suitably configured key that has been inserted into the keyway 302, and spring-biased tumblers (not shown) that cooperate with the key, the plug and the housing to permit the plug 320 to rotate a cam 330 carried by the rear end region of the plug between a locked position depicted in FIGS. 1, 8, 9, 12 and 13, and an unlocked position depicted in FIGS. 2, 10 and 11.

Referring to FIG. 4, the latch mechanism 100 includes a hook-shaped latch arm 110, an operating arm 120 which defines the operating projection 150 that extends through the curved back wall slot 240 of the housing 210, a stepped-diameter bushing 130 which has a major diameter 132 and reduced diameter portions 134, 136 that extend through holes 122, 133 formed in the arms 120, 130, respectively, and a headed mounting pin 145 that extends through the bushing 130 to mount the latch arm 110 and the operating arm 120 on a frame 160 for pivotal movement about the axis of the pin 145.

The frame 160 has a flat base portion 162 that is provided with a hole 164 through which the mounting pin 145 extends. As is best seen in FIG. 3, the hole 164 is enlarged at its front end, as is indicated by the numeral 166, to receive a retaining washer 168 therein that grips the pin 145 to hold the components of the latch mechanism 100 in assembled relationship. The frame 160 also has a pair of dog-legged arms 185, 187 that extend rearwardly and upwardly from the flat base portion 162 to define a striker receiving channel 115 between the arms 185, 187. The arm 185 has a tapered surface 186, and the arm 187 has a rounded corner surface 188—and the surfaces 186, 188 can aid in guiding a striker that is misaligned with the channel 115 into the channel 115.

Referring to FIG. 4, the hole 133 formed through the latch arm 110 is provided in a relatively flat end region of the latch arm 110. A dog-legged central region of the latch arm 110 connects the flat end region that carries the hole 133 to the hook-shaped end region 114, and serves to position the hook-shaped end region 114 in a plane closely overlying the plane of the arm 187 of the frame 160 so that the hook-shaped end region 114 moves closely alongside the arm 187 in pivoting between the latched position shown in FIGS. 8, 9 and the unlatched position shown in FIGS. 10, 11.

Figure 17:
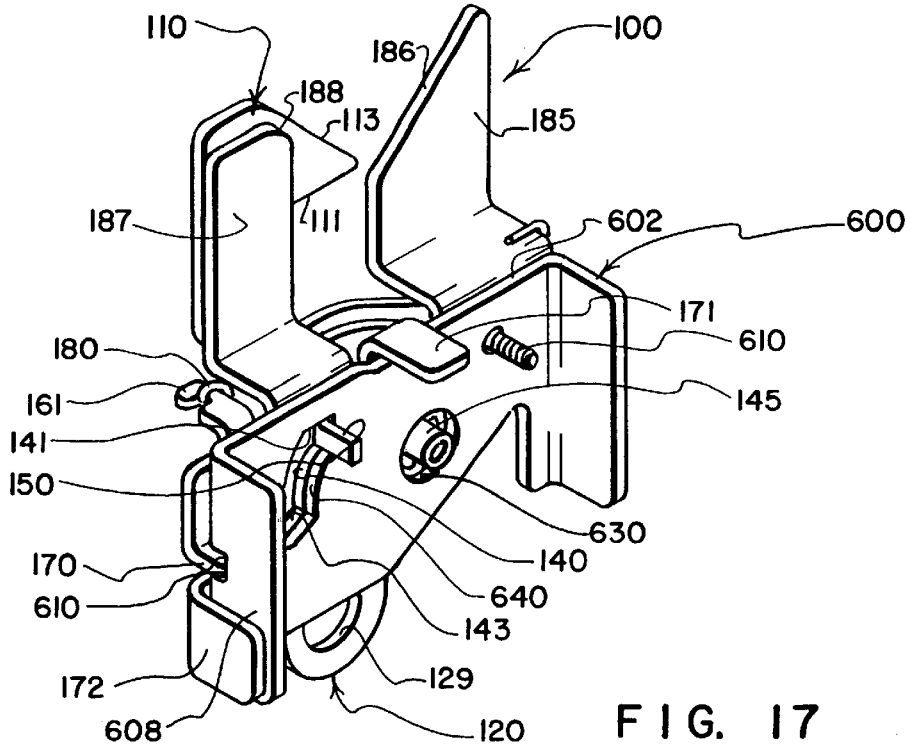
FIG. 17 is a perspective view of a latch assembly that includes the latch mechanism of FIG. 1 but with a U-shaped mounting bracket substituted for the pan-shaped housing of FIG. 1.
Figure 18:
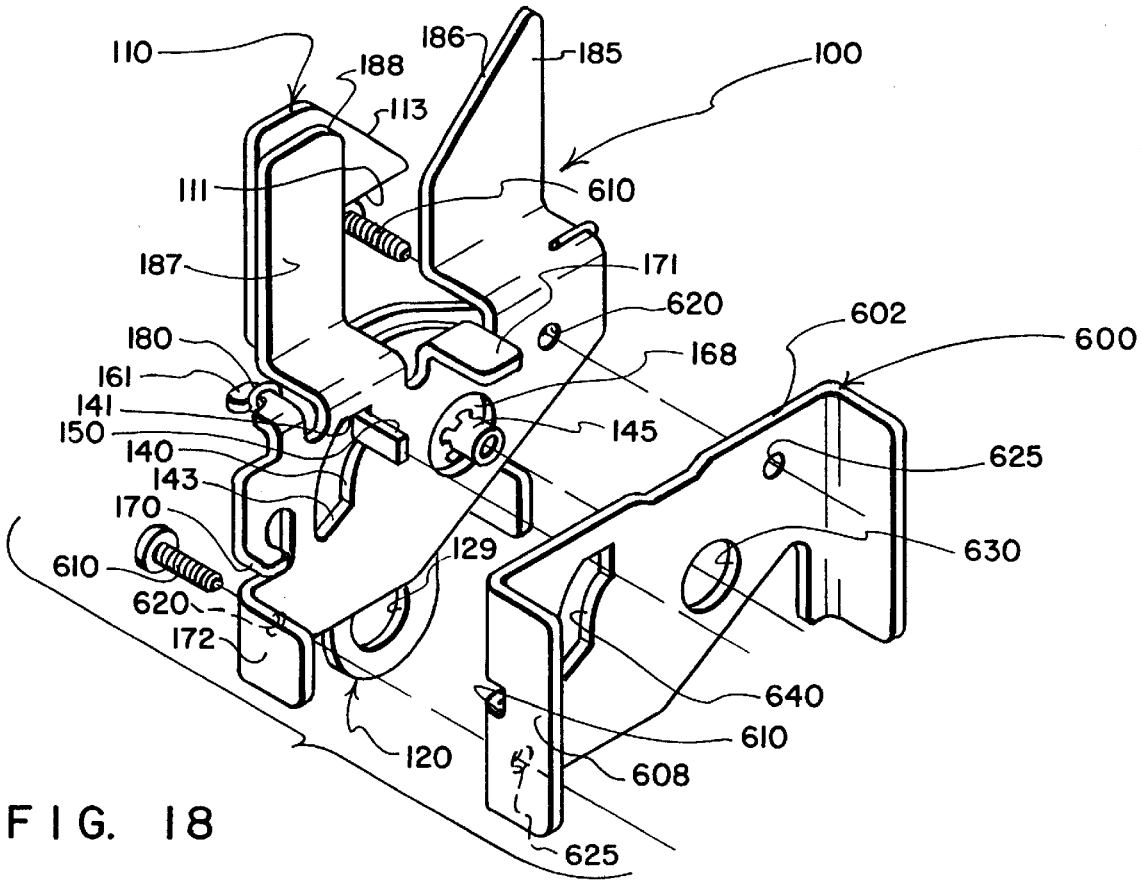
FIG. 18 is an exploded perspective view showing the latch mechanism of FIG. 17 with the mounting bracket separated therefrom.

Referring to FIG. 4, the flat base portion 162 of the frame 160 is provided with a curved opening 140 that is shaped the same as and that aligns with the curved opening 240 provided in the flat portion 219 of the rear wall 218 of the housing 210. Opposite outer and inner ends 141, 143 and 241, 243 of the curved openings 140 and 240, respectively, may be engaged by the operating arm projection 150 to thereby limit the permitted range of angular movement of the operating arm 120 about the axis of the pin 145. Limiting the range of angular movement of the operating arm 120 by the length and configuration of the slot 140 holds true even if a simple U-shaped mounting bracket 600 is substituted for the pan-shaped housing 600, as depicted in FIGS. 17 and 18. Referring to FIGS. 17 and 18, it will be seen that the bracket 600 is provided with a curved opening 640 that is the same size and shape as, and that overlies the curved opening 140 to receive the projection 150 of the operating arm 120. The opening 640 has end regions 641 and 643 that overlie the end regions 141 and 143, respectively, and thus may be engaged by the operating arm projection 150 at opposite ends of the permitted range of angular movement of the operating arm 120.

Referring to FIGS. 3 and 4, the frame 160 may be provided with forwardly turned tabs 171, 172 that are designed to extend closely alongside side and end walls 202, 208, respectively, of the pan-shaped housing 210 when the pin 145 extends through the hole 230 in the back wall 218 of the housing 210. Also, the frame 160 is provided with a forwardly turned tab 170 that is configured to extend into a concavity created in the rear face of the back wall 218 that is formed when the handle stop 250 is formed by stamping a portion of the back wall 218 forwardly to project into the recess 216 of the pan-shaped housing 210. Likewise, the mounting bracket 600 depicted in FIGS. 17 and 18 has wall portions 602, 608 that are engaged by the forwardly extending projections 171, 172, and a recess 610 that is configured to receive the forwardly projecting tab 170. The positioning of the forwardly extending tabs 170, 171, 172 adjacent the described portions of the housing 210 and adjacent the described portions of the mounting bracket 600 serve to enhance the rigidity of the connection that is provided between the frame 160 and the housing 210, and the connection that is provided between the frame 160 and the mounting bracket 600—although, in some instances, the presence of the tabs 171, 172 may not be required to provide a sufficiently rigid connection, so the tabs 171, 172 are viewed as optional and can, in some instances, be eliminated. If, on the other hand, additional rigidity is desired, the forwardly projecting tabs 171, 172 can be welded to the side and/or end walls 202, 208, respectively, of the housing 210, or to the side and/or end walls 602, 608 of the bracket 600.

Referring to FIGS. 3 and 4, a front end portion of the pin 145 that extends through the hole 230 into the recess 216 of the housing 210 may be riveted or suaged or "headed" as is indicated by the numeral 175 in FIG. 2 to assist in providing a rigid connection between the frame 160 and the housing 210. Referring to FIGS. 17 and 18, the mounting bracket 600 can be provided with a sizable hole 630 that loosely receives the front end of the pin 145, or can be provided with a smaller hole (such as the hole 230 provided in the rear wall 218 of the housing 210), which permits a front end portion of the pin 145 that extends through a smaller hole of this type to be riveted or suaged or "headed" to assist in providing a rigid connection between the frame 160 and the bracket 600.

Referring to FIGS. 3 and 4, the operating arm 120 and the frame 160 are provided with small hook-shaped formations 131, 161, respectively, to receive opposite ends of a coiled tension spring 180 that biases the operating arm 120 toward a position wherein the operating projection 150 engages the outer end 241 of the curved back wall slot 240. In biasing the projection 150 toward engagement with the outer end 241 of the slot 240, the fact that the projection 150 engages the rear portion 226 of the handle 220 causes the biasing effect of the coiled tension spring 180 to be transmitted to the handle 220, causing the handle 220 to be biased toward its nested, non-operated position.

Referring to FIG. 3, the operating arm 120 has a relatively flat central region 121 that is provided with a link connection hole 129 at a location spaced from the mounting hole 122 that receives the reduced diameter portion 134 of the bushing 130. Referring to FIG. 20, if it is desired to connect a rod-like link 666 to the operating arm 120, a headed connector 667 preferably is used to provide a pivotal connection therebetween. The connector 667 has a set screw 668 that can be tightened into engagement with the link 666 after the link 666 has been inserted through a hole 669 formed through the connector 667. Illustrations of the use of the connector 667 to couple rod-like links to the operating arm 120 are provided in FIGS. 15, 16 and 19.

Referring to FIG. 4, a torsion coil spring 190 has a central coil 192 that wraps loosely about the major diameter 132 of the bushing 130, with hook-shaped end regions 194, 196 that hook into engagement with the frame 160 and the latch arm 110—to bias the latch arm 110 toward a position wherein a hook-shaped end region 114 of the latch arm 110 extends across a striker receiving channel 115 defined between spaced upstanding guide formations 166, 168 of the frame 160. The hook-shaped end region 114 has first and second surfaces 113 and 111, respectively, that intersect at an angle to define a point. The first surface 113 is engageable by a striker entering the striker-receiving channel 115—and, when so engaged, causes the latch arm 110 to pivot from the latched position of FIGS. 8 and 9 to the unlatched position of FIGS. 10 and 11. When the striker passes by the hooked shaped end region 114 as it travels farther into the receiving channel 115, it no longer engages the first surface 113 and therefore permits the latch arm 110 to counterrotate back to its latched position wherein the second surface 111 blocks the escape of the striker from the striker receiving channel 115 until the latch arm 110 is once again pivoted to its unlatched position so as to release the striker.

When the latch arm 110 is pivoted by slamming a striker 555 into engagement with the tapered end surface 113, the pivoting action of the latch arm 110 in moving from its latched position to its unlatched position causes no corresponding movement of the operating arm 120 due to the provision therebetween of what is commonly referred to in the art as a "lost motion connection." The "lost motion connection" referred to here results from the provision of a pair of spaced-apart engagement surfaces or "stops" 116, 117 on the latch arm 110, either of which may be engaged by a rearwardly turned projection 125 of the operating arm 120 when the latch arm 110 is pivoted (or, stated in a different way, either of which may be engaged by the projection 125 of the operating arm 120 when the operating arm is pivoted).

Figure 8:
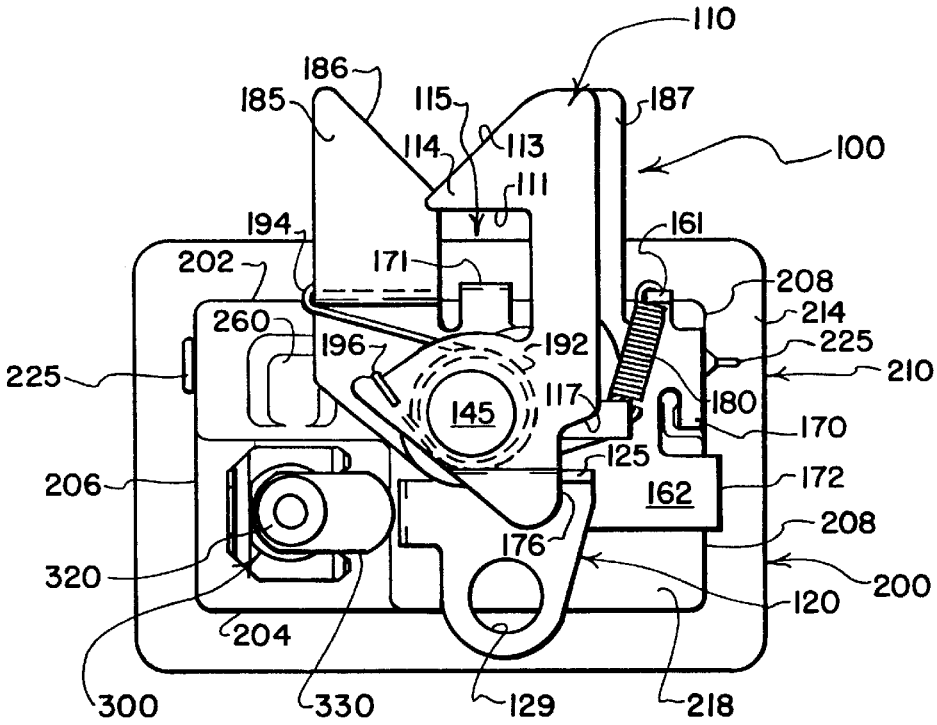
FIG. 8 is a rear elevational view of the stand-alone latch assembly of FIG. 1, with components of the latch mechanism in their normal, non-operated positions, and with the key operated lock "locked;"
Figure 9:
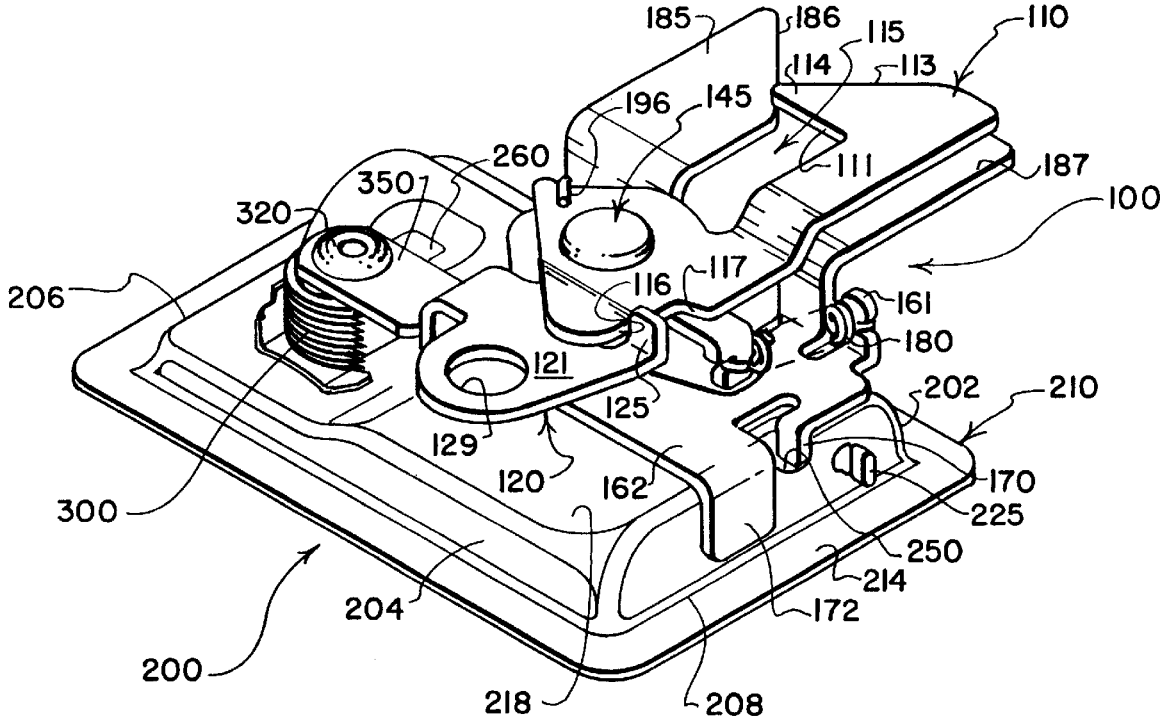
FIG. 9 is a perspective view showing principally rear features of the assembly depicted in FIG. 8.
Figure 12:
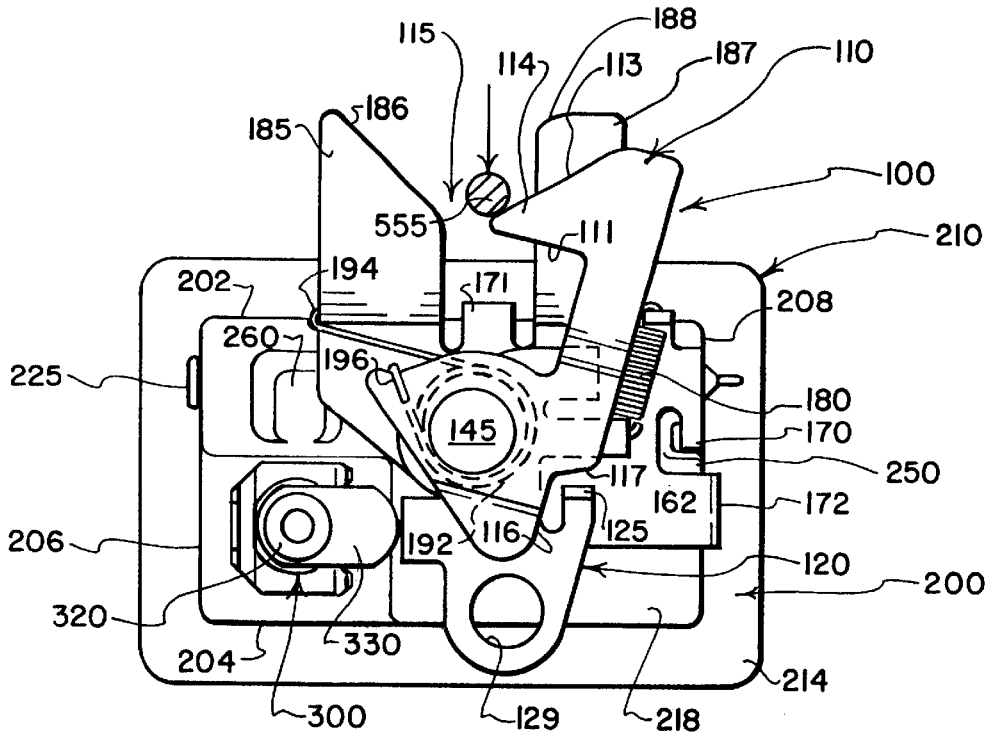
FIG. 12 is a rear elevational view of the stand-alone latch assembly of FIG. 1, with selected components of the latch mechanism being moved due to the latch mechanism's being slammed into latching engagement with a striker (while the paddle handle remains in the non operated position depicted in FIG. 1 and while the key-operated lock remains "locked"), with the striker depicted in cross-section.
Figure 13:
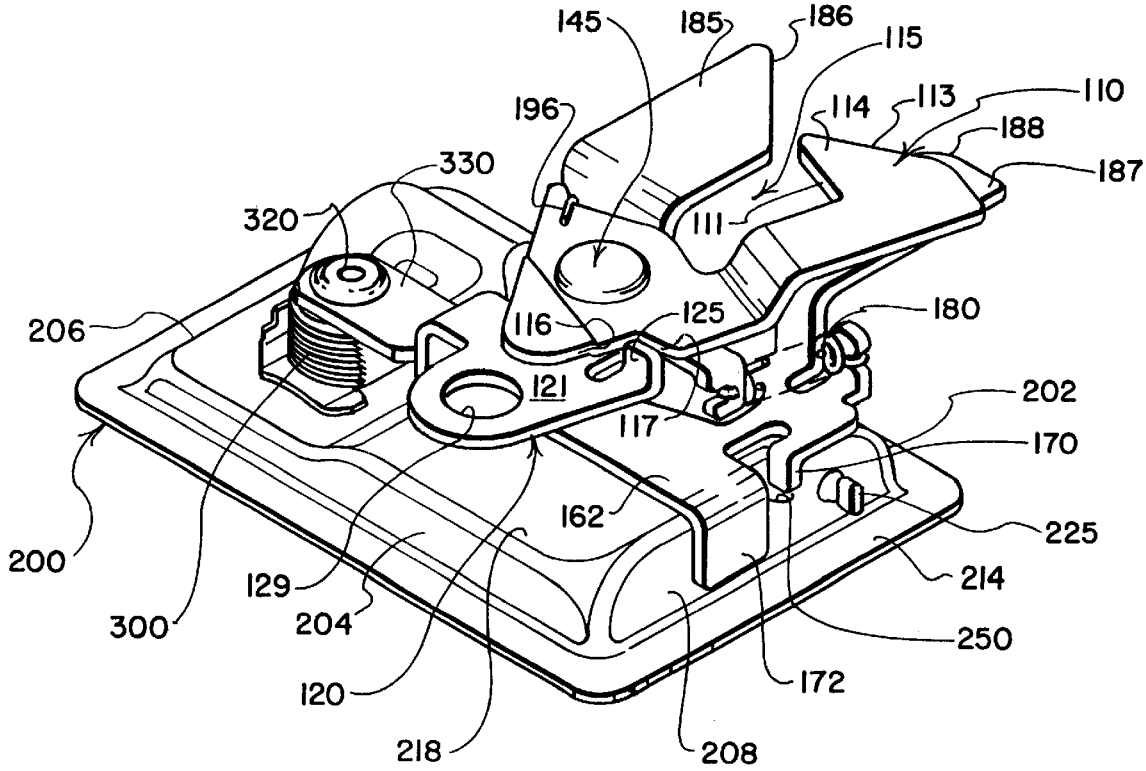
FIG. 13 is a perspective view showing principally rear features of the latch assembly with its components oriented as depicted in FIG. 12.

The latch arm surface 116 normally engages the operating arm projection 125 when the latch arm 110 is in its latched position, as shown in FIGS. 8 and 9. When the latch arm 110 is pivoted from its latched position (FIGS. 8 and 9) to its unlatched position (FIGS. 9 and 10) by slamming a striker 555 into engagement with the tapered end surface 113 (as depicted in FIG. 12), the latch arm surface 116 moves away from the operating arm projection 125, bringing the surface 117 nearly into engagement with the projection 125. By positioning the surface 117 so that it does not need to engage the projection 125 in order to permit the latch arm 110 to latchingly engage the striker 555, the latch arm 110 is permitted to pivot to its unlatched position without causing corresponding pivotal movement of the operating arm 120 (hence the movement of the latch arm 110 can be said to be "lost" to the operating arm 120 in the sense that the pivotal movement of the latch arm 110 is not transmitted to and does not cause corresponding movement of the operating arm 120).

Figure 10:
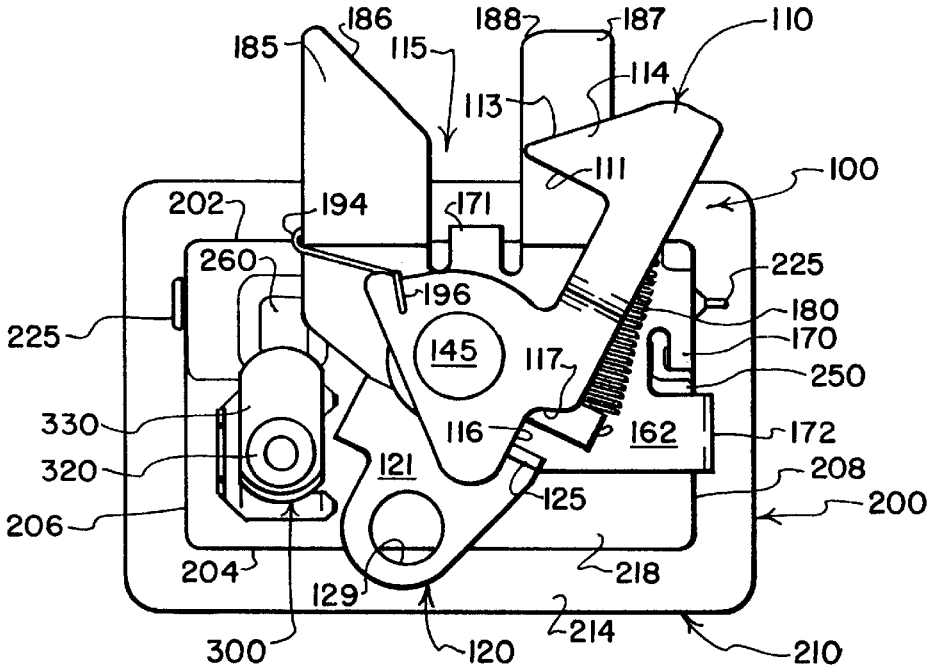
FIG. 10 is a rear elevational view of the stand-alone latch assembly of FIG. 1, with components of the latch mechanism operated by pivoting the paddle handle to the operated position depicted in FIG. 2 at a time when the key-operated lock is "unlocked;"
Figure 11:
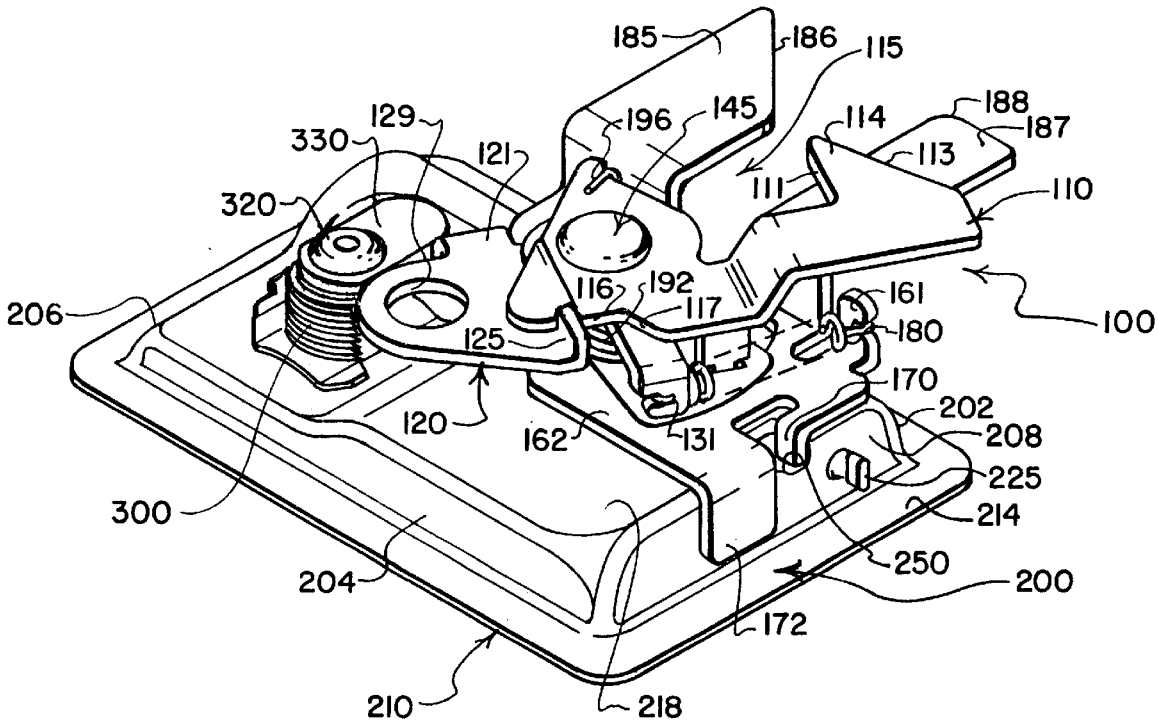
FIG. 11 is a perspective view showing principally rear features of the operated latch assembly depicted in FIG. 10.

When, on the other hand, the operating arm 120 is pivoted by the handle 220 to an operated position as depicted in FIGS. 10 and 11, the engagement of the operating arm projection 125 with the surface 116 of the latch arm 110 causes the latch arm 110 to pivot with the operating arm 120 to move the latch arm 110 from its normally latched position to its unlatched position so that the striker 555 can be released from being confined in the channel 115 by the hook-shaped end region 114 of the latch arm 110.

Referring again to FIG. 4, two other components of the latch mechanism 100 deserve mention, namely a nylon or mylar shutter 195, and a nylon or mylar washer 199. The shutter 195 has a hole 196 sized to receive a forwardly projecting reduced diameter end of the bushing 130, shown in dotted lines and indicated by the numeral 135. The shutter 195 also has an opening 197 that is sized and positioned to closely receive the forwardly extending operating tab 150 of the operating arm 120—so as to overlie open areas of the curved slot 140 to prevent the passage through the slot 140 (and through the slot 240 of the housing 210) of unwanted foreign matter such as dust and the like. When the latch assembly 100 is used with the mounting bracket 600, the shutter 195 normally is eliminated. The washer 199 may be provided between the latch arm 110 and the operating arm 120 (as an option) if needed to provide lubricity or to serve as a shim to give the relatively movable parts of the latch mechanism 100 proper fit and feel, and/or to prevent looseness.

Figure 14:
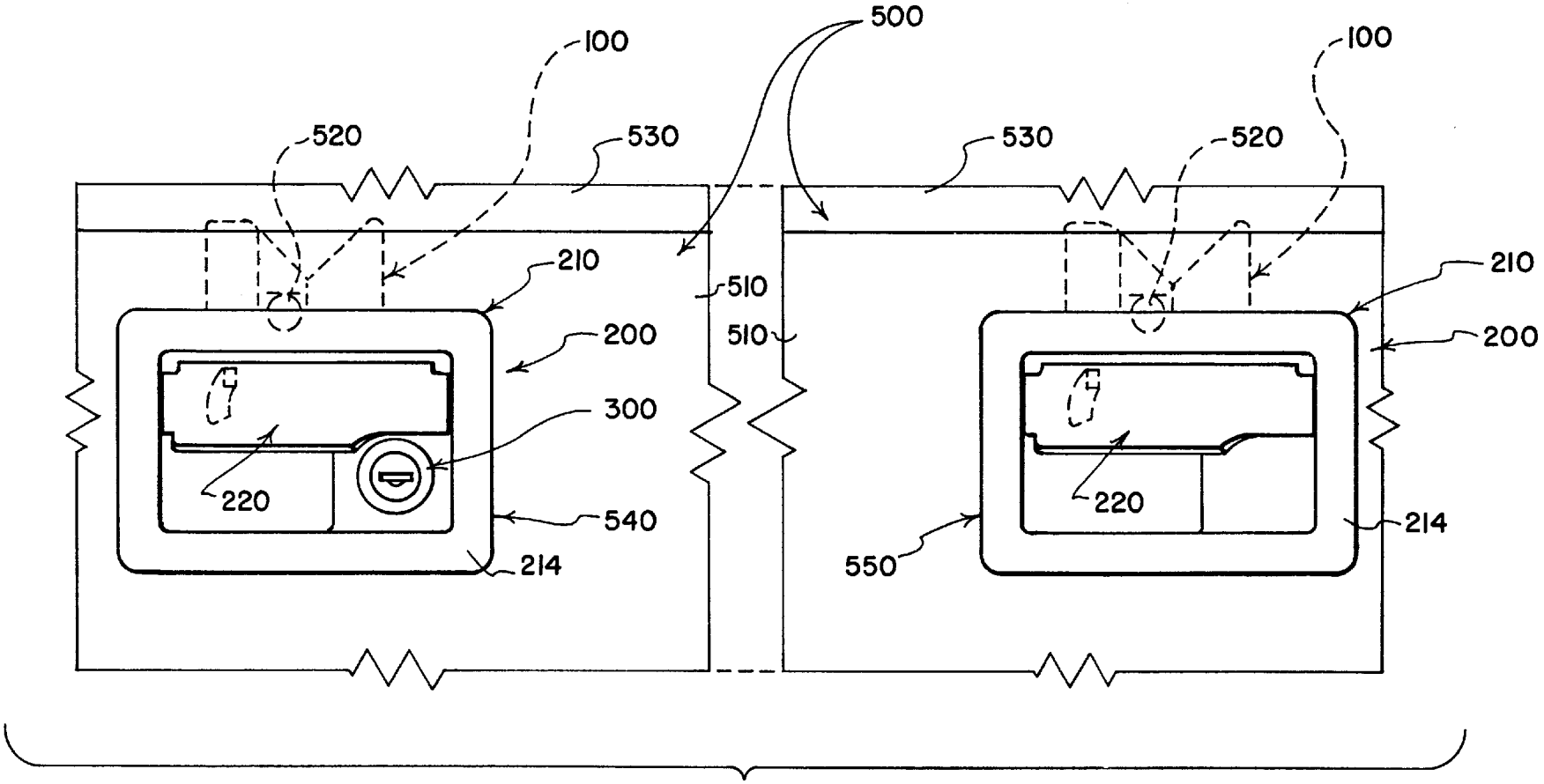
FIG. 14 is a foreshortened side elevational view of exterior portions of an upstanding side wall and lid of an elongate tool box of the type often mounted on pickup trucks (see the aforementioned U.S. Pat. Nos 5,816,630 and 5,308,126 wherein such tool boxes are disclosed), with a pair of linkage connected paddle handle operated latch mechanisms of the type shown in FIG. 1 mounted thereon, one of which is provided with a key operated lock that has its keyway in a locked orientation, with dotted lines depicting selected components of the latch mechanisms in latched engagement with strikers carried by the lid.
Figure 15:
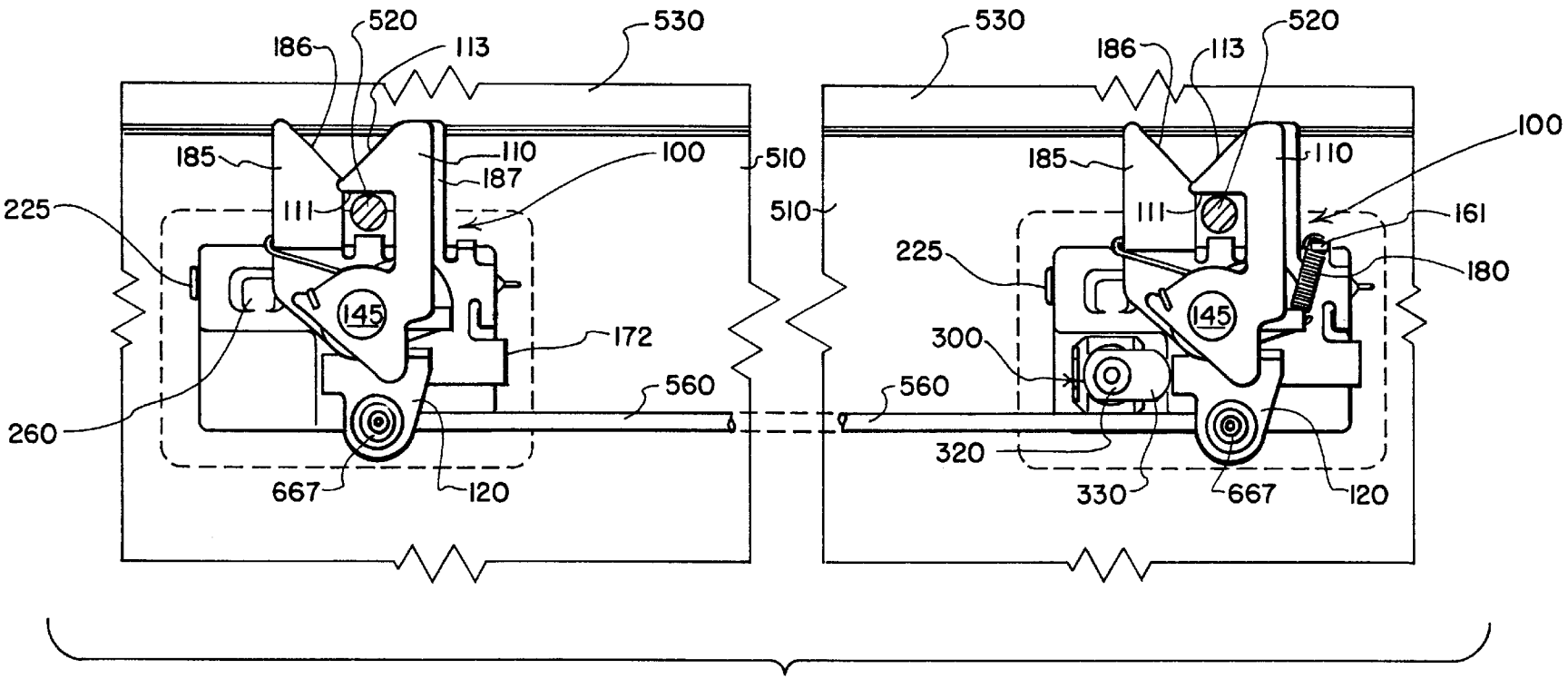
FIG. 15 is a foreshortened side elevational view of interior portions of the tool box side wall and lid, showing rear portions of the latch mechanisms in latched engagement with lid-carried strikers that are depicted in cross-section, with the key-operated lock "locked;"
Figure 16:
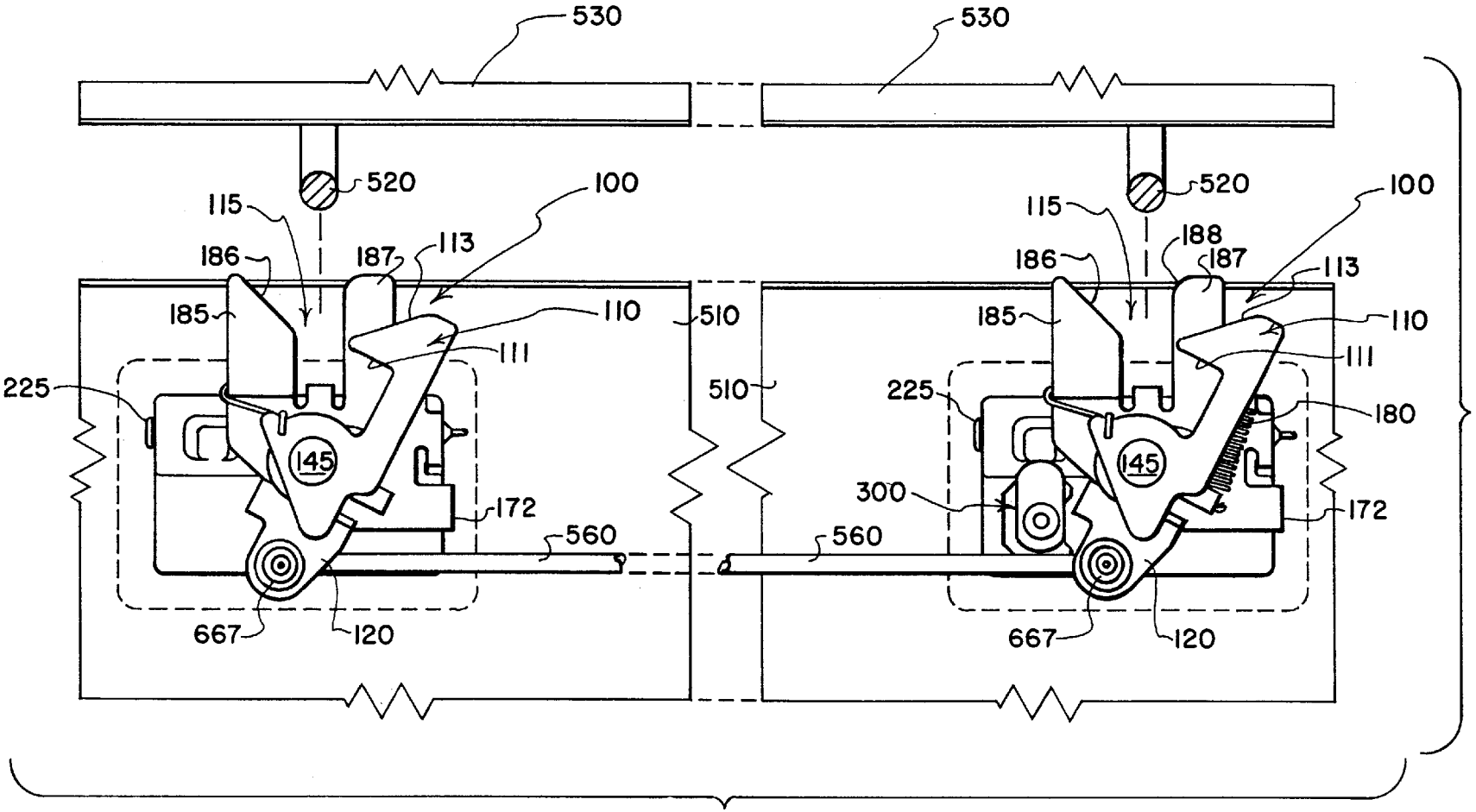
FIG. 16 is a view similar to FIG. 15 but with the lid raised out of engagement with the sidewall, with the lid-carried strikers raised out of latched engagement with the latch mechanisms, and with the latch mechanisms operated by pivoting one or the other of the operating handles to the operated position shown in FIG. 2 wherein the key-operated lock is "unlocked;"

Referring to FIGS. 14–16, a pair of the latch assemblies shown in FIG. 1 may be mounted on a side wall 510 of a tool box 500 to receive and latchingly retain strikers 520 carried by a lid 530 of the tool box 500. The reference numeral 540 indicates one of these latch assemblies which is provided with one of the key operated locks 300 described previously. The reference numeral 550 indicates the other of these latch assemblies, which has no key operated lock associated therewith. Referring to FIGS. 15 and 16, a rod-like link 560 is shown interconnecting the operating arms 120 of the latch assemblies 540, 550 for concurrent pivotal movement about the axes of the pivot pins 145 of the latch assemblies 540, 550.

Except for the three-digit reference numerals set in out in the paragraph just above that begin with the numeral "5, " all other reference numerals that appear in FIGS. 14–16 correspond to the reference numerals utilized in conjunction with FIGS. 1–13, for the latch assemblies 540, 550 are the same as the stand-alone latch assembly, features of which are depicted in FIGS. 1–13. Accordingly, the descriptions provided above of the components of the latch mechanism 100 and the operating device 200 are equally applicable to the linkage interconnected latch assemblies 540, 550.

The connection by the link 560 of the latch assemblies 540, 550 provides a plural-point latching system that utilizes a pair of the latch mechanisms 100, each of which is positioned to receive and latchingly retain a separate one of the strikers 520, with each of the latch mechanisms 100 being capable of being slammed into latching engagement with its associated striker 520 regardless of whether the key operated lock 300 is "locked" or "unlocked," and without causing either of the operating handles 220 of the latch assemblies 540, 550 to move out of its nested non-operated position when slamming of the latch mechanisms 100 into engagement with the strikers 520 takes place. Still another feature of the latching system depicted in FIGS. 14–16 is that, when either of the operating handles 220 of either of the operating devices 200 of either of the latch assemblies 540, 550 is operated (as by moving it to the operated position shown in FIG. 2), this will cause the associated operating 120 arm to pivot the associated latch arm 110 to an unlatched position; and, the pivoting of one of the operating arms 120 to an operated position will (due to the interconnection of the operating arms 120 for concurrent movement by the rod-like link 560) cause the other of the operating arms 120 to pivot the other of the latch arms 110 to its unlatched position, which will cause both of the latch assemblies 540, 550 to concurrently release their associated strikers 520 (as is depicted in FIG. 16).

In FIG. 15, the strikers 520 are shown being latchingly retained by the latch arms 110. In FIG. 16 the latch arms 110 and the operating arms 120 are shown pivoted to their unlatched and operated positions, respectively, which causes the strikers 520 are released to permit the lid 530 to move away from the side wall 510 of the tool box 500 (i.e., to permit the lid 530 to be "opened" so that the interior of the tool box 500 can be accessed).

Referring to FIG. 17, one of the latch mechanisms 100 is shown connected to a mounting bracket 600 instead of to a pan-shaped housing 210 by two threaded fasteners 610 that extend through holes 620 formed in the base 162 of the frame 160 and are threaded into holes 625 formed in the mounting bracket 600. In FIG. 18 the character of the U-shaped mounting bracket 600 can be more clearly seen. If one of the latch mechanisms 100 is to be secured to one of the mounting brackets 600, the end of the pivot pin 145 that is viewable in FIG. 18 may be suaged to ensure that the elements of the latch mechanism 100 remain securely connected together.

Figure 19:
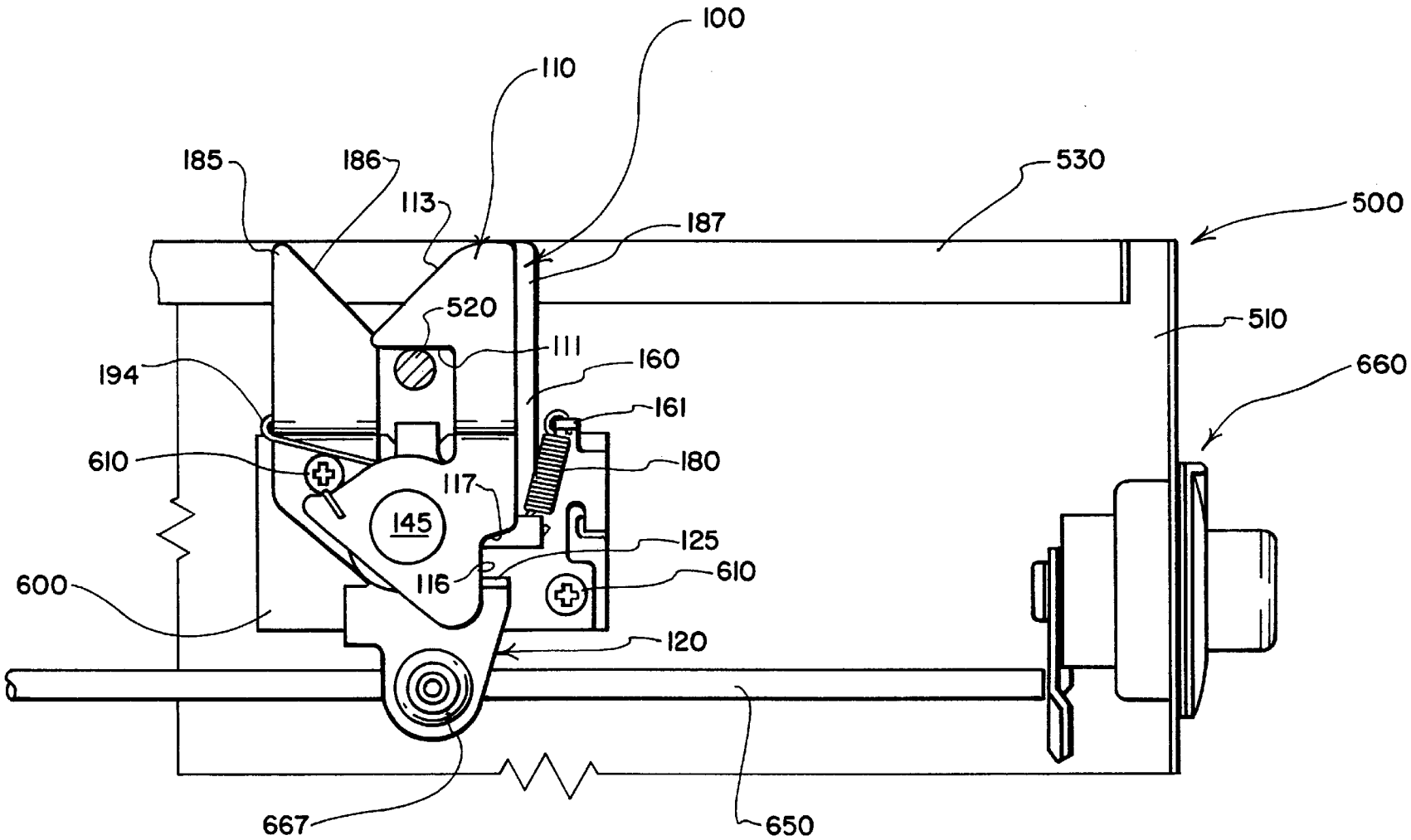
FIG. 19 is a side elevational view similar to FIG. 15 showing one of the latch assemblies of FIG. 17 mounted in a tool box and provided with a rod-like link that enables the latch mechanism to be operated by a push button operating device of the general type disclosed in U.S. Pat. No. 5,816,630 and in the referenced Push Button Lock System Case, with the rod-like link also being connectible to other latch assemblies of the FIG. 14 type to provide a slammable plural point latching system, if desired; and, FIG. 20 is a perspective view showing the operating arm of one of the latch mechanisms depicted in FIGS. 14–19 together with a portion of a rod-like link and a connector for providing a pivotal connection between the operating arm and the link.
Figure 20:
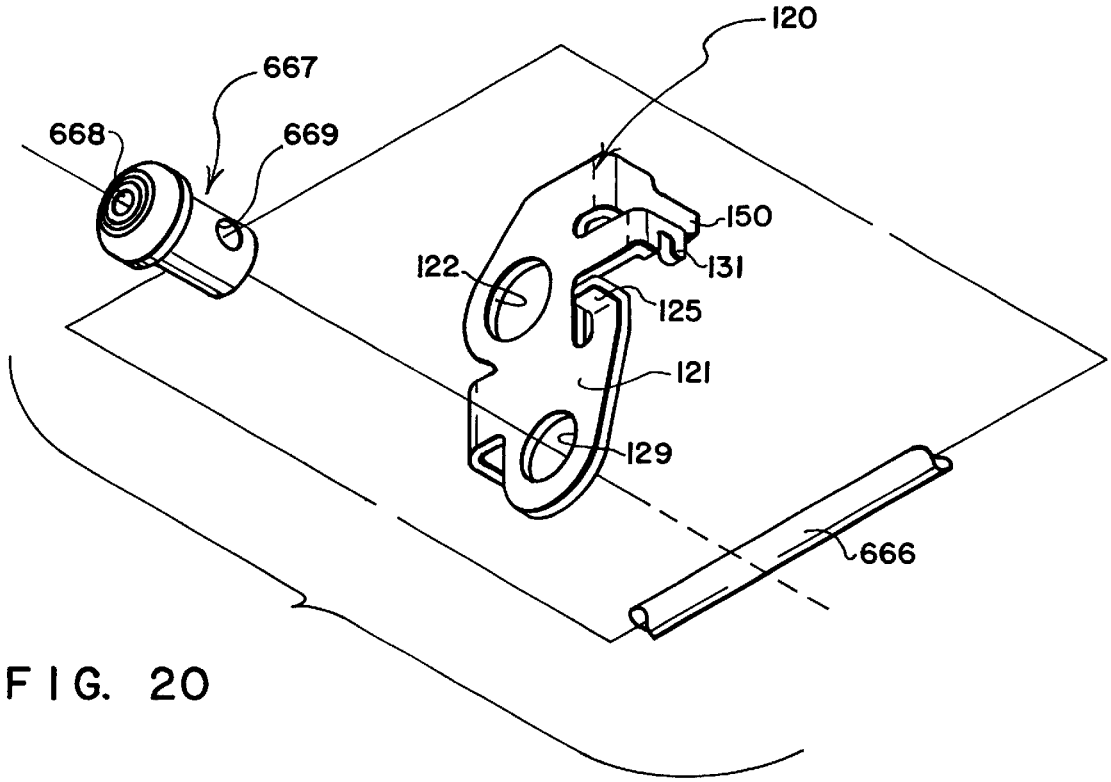

In FIG. 19, the latch mechanism/mounting bracket assembly of FIG. 17 is provided with a rod-like link 650 that enables the latch mechanism 100 to be unlatched by a push-button type operating device 660.

While a variety of push button operating devices are commercially available, in preferred practice the operating device 660 preferably is of the general type described in U.S. Pat. No. 5,816,630 or in the referenced Push Button Lock System Case. While only a short length of the rod-like link 650 is needed to drivingly connect the operating device 660 to the latch mechanism 100, the rod-like link 650 may also connect with other latch mechanisms 100 (not shown) in the manner that a plurality of the latch mechanisms are shown interconnected in FIGS. 15 and 16. Operation of the latch mechanism 100 in the embodiments of FIGS. 1–13, FIGS. 14–16 and FIGS. 17–19 remains substantially the same regardless of the character of the operating device or operating devices that is/are used therewith, and regardless of whether the latch mechanism is part of a stand-alone unit (as depicted in FIGS. 1–13) or a plural point latching system (as depicted in FIGS. 14–16), or a remotely operated latch system (as depicted in FIG. 19).

As will be apparent from the foregoing description, the latch mechanism of the present invention provides a versatile unit that can be attached to an operating device for local operation, or link-connected to remotely located operating devices, or link-connected to other similar latch mechanisms, or a combination of these possibilities. As is illustrated by the latch system of FIGS. 15–17, the resulting latch system can offer the option of utilizing a single key-operated lock cylinder to "lock" all of the operating devices from operating all of the latch mechanisms of a latching system.

While the foregoing description discloses the preferred manner in which the latch and lock system of the present invention is utilized on lengthy tool boxes of the type often mounted on pickup trucks and the like, those who are skilled in the art will recognize that features of invention also can be utilized on doors and in conjunction with other types of closures, and that the latch mechanisms can be utilized with other types of latch and lock systems.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention as hereinafter claimed. It is intended to protect whatever features of patentable novelty exist in the invention disclosed.

What is claimed is:

1. A latch assembly for releasably retainingly engaging a striker, comprising:

a) a frame formed as a one-piece stamping from sheet metal and having a relatively flat base portion that extends within a first plane, a pair of formations that extend away from the base portion in a plane that substantially parallels the first plane to define first and second arms that define a striker receiving channel between opposed portions of the first and second arms;

b) means for defining a generally cylindrical mounting pin that is connected to and extends away from the flat base portion along an axis that is substantially perpendicular to the first plane;

c) an operating arm formed as a one-piece stamping from sheet metal and having a relatively flat central region positioned to closely overlie the relatively flat base portion of the frame, with a hole being formed through the relatively flat central region through which the mounting pin extends to connect the operating arm and the frame for relative pivotal movement about said axis;

d) means for defining a limited range of permitted relative pivotal movement that can take place between the operating arm and the frame including first and second spaced-apart stop formations defined by a selected one of the frame and the operating arm, and a stop engageable formation defined by the other of the frame and the operating arm that is configured to engage the first stop formation at one end of said range of movement, and to engage the second stop formation at the other end of said range of movement;

e) a latch arm formed as a one-piece stamping from sheet metal and having a relatively flat portion positioned to closely overlie the relatively flat central region of the operating arm, with a hole being formed through the relatively flat portion through which the mounting pin extends to connect the latch arm and the frame for relative pivotal movement about said axis, with the latch arm defining a hook-shaped formation at a location spaced from said axis, with the hook-shaped formation having a first surface configured to be engaged by a striker that is moving along a path of travel into the striker receiving channel to cause pivotal movement of the latch arm in one direction of rotation about said axis to pivot the hook-shaped formation out of said path of travel, and with the hook-shaped formation also having a second surface configured to retain the striker within the striker receiving channel once the hook-shaped formation has pivoted in a direction of rotation opposite to said one direction to position the second surface to block withdrawal of the striker from the channel;

f) means for permitting the latch arm to move in said one direction of rotation without causing corresponding pivotal movement of the operating arm in said one direction to thereby enable a striker to be moved rapidly into the striker receiving channel and into latched engagement with the latch assembly without causing pivotal movement of the operating arm if the striker engages the first surface and thereby causes the latch arm to pivot out of the path of travel followed by the striker in moving into the striker receiving channel;

g) biasing means for biasing the latch arm to apply torque thereto for pivoting the latch arm in said opposite direction of rotation, and for utilizing the lost motion connection means to transfer from the latch arm to the operating arm said torque applied by the biasing means to pivot the operating arm in said opposite direction and to thereby bias the stop engageable formation toward engagement with the second stop formation; and, h) means for defining on the operating arm at a location spaced from said axis at least one connection formation for receiving an application of torque to the operating arm for rotating the operating arm in said one direction of rotation to drive the latch arm in said one direction of rotation to pivot the hook-shaped formation of the latch arm to position the second surface so that it does not block withdrawal of the striker from the striker receiving channel to thereby unlatch the latch mechanism from retainingly engaging the striker.

2. The latch assembly of claim 1 wherein at least one of the first and second arms has an end region configured to guide into the striker receiving channel a striker that is moving toward but not in perfect alignment with the striker receiving channel.

3. The latch assembly of claim 1 wherein the means for defining a generally cylindrical mounting pin is a headed pin that is connected at one end to the relatively flat central region of the frame, and that defines near the opposite end thereof a head formation having a shoulder configured to closely overlie the relatively flat portion of the latch arm.

4. The latch assembly of claim 1 wherein the means for defining a limited range of relative pivotal movement that can take place between the operating arm and the frame includes a projection of the operating arm that extends through an elongate slot formed through the relatively flat base portion of the frame to define the stop engageable formation, and wherein the first and second stop formations are defined by opposed end regions of the elongate slot.

5. The latch assembly of claim 4 wherein the projection of the operating arm carries a shutter element for at least partially closing the elongate opening to the passage of foreign matter therethrough.

6. The latch assembly of claim 1 wherein the biasing means includes a torsion spring having a coiled central region that extends about said axis, a first end region that engages a selected one of the first and second arms of the frame, and a second end region that engages the latch arm for biasing the latch arm to pivot about said axis in said opposite direction of rotation.

7. The latch assembly of claim 1 wherein the means for defining a point of connection includes a linkage connection hole formed through relatively flat central region of the operating arm at a distance spaced from the pivot axis, and means for extending through the connection hole to establish a pivotal connection with a link that connects the operating arm to a device located at a distance spaced from the latch assembly.

8. The latch assembly of claim 7 in combination with another latch assembly, wherein the link connects the latch assemblies so as to be substantially concurrently unlatched.

9. The latch assembly of claim 7 in combination with a remotely located operating assembly having an operator-engageable element that can be moved from a normal position to an operated position, and wherein the link connects the latch assembly with the operating assembly so as to effect unlatching of the latch assembly in response to movement of the operator-engageable element from the normal position to the operated position.

10. The latch assembly of claim 1 wherein the first and second arms have dog-legged configurations that serve to define the striker receiving channel at a location spaced from the first plane, and wherein the latch arm has a dog-legged configuration that positions the hook-shaped formation to closely overlie a selected one of the first and second arms as the hook-shaped formation moves between latched and unlatched positions.

11. A latch assembly for releasably retainingly engaging a striker, comprising:

a) a frame formed as a one-piece stamping from sheet metal and having a relatively flat base portion that extends within a first plane, a pair of formations that extend away from the base portion in a plane that substantially parallels the first plane to define first and second arms that define a striker receiving channel between opposed portions of the first and second arms;

b) means for defining a generally cylindrical mounting pin that is connected to and extends away from the flat base portion along an axis that is substantially perpendicular to the first plane;

c) an operating arm formed as a one-piece stamping from sheet metal and having a relatively flat central region positioned to closely overlie the relatively flat base portion of the frame, with a hole being formed through the relatively flat central region through which the mounting pin extends to connect the operating arm and the frame for relative pivotal movement about said axis;

d) means for defining a limited range of permitted relative pivotal movement that can take place between the operating arm and the frame including first and second spaced-apart stop formations defined by a selected one of the frame and the operating arm, and a stop engageable formation defined by the other of the frame and the operating arm that is configured to engage the first stop formation at one end of said range of movement, and to engage the second stop formation at the other end of said range of movement;

e) a latch arm formed as a one-piece stamping from sheet metal and having a relatively flat portion positioned to closely overlie the relatively flat central region of the operating arm, with a hole being formed through the relatively flat portion through which the mounting pin extends to connect the latch arm and the frame for relative pivotal movement about said axis, with the latch arm defining a hook-shaped formation at a location spaced from said axis, with the hook-shaped formation having a first surface configured to be engaged by a striker that is moving along a path of travel into the striker receiving channel to cause pivotal movement of the latch arm in one direction of rotation about said axis to pivot the hook-shaped formation out of said path of travel, and with the hook-shaped formation also having a second surface configured to retain the striker within the striker receiving channel once the hook-shaped formation has pivoted in a direction of rotation opposite to said one direction to position the second surface to block withdrawal of the striker from the channel;

f) means for defining a lost-motion connection between the latch arm and the operating arm for permitting the latch arm to move in said one direction of rotation without causing corresponding pivotal movement of the operating arm in said one direction when torque is applied to the latch arm to effect said one direction rotation of the latch arm, and for permitting the operating arm to drive the latch arm in said one direction of rotation to thereby effect corresponding pivotal movement of the latch arm and the operating arm in said one direction when torque is applied to the operating arm to effect said one direction rotation of the operating arm;

g) biasing means for biasing the latch arm to apply torque thereto for pivoting the latch arm in said opposite direction of rotation, and for utilizing the lost motion connection means to transfer from the latch arm to the operating arm said torque applied by the biasing means to pivot the operating arm in said opposite direction and to thereby bias the stop engageable formation toward engagement with the second stop formation; and, h) means for defining a point of connection on the operating arm at a location spaced from said axis for receiving an application of torque to the operating arm for rotating the operating arm in said one direction of rotation to drive the latch arm in said one direction of rotation to pivot the hook-shaped formation of the latch arm to position the second surface so that it no longer blocks withdrawal of the striker from the striker receiving channel to thereby unlatch the latch mechanism from retainingly engaging the striker.

12. The latch assembly of claim 11 wherein at least one of the first and second arms has an end region configured to guide into the striker receiving channel a striker that is moving toward but not in perfect alignment with the striker receiving channel.

13. The latch assembly of claim 11 wherein the means for defining a generally cylindrical mounting pin is a headed pin that is connected at one end to the relatively flat central region of the frame, and that defines near the opposite end thereof a head formation having a shoulder configured to closely overlie the relatively flat portion of the latch arm.

14. The latch assembly of claim 11 wherein the means for defining a limited range of relative pivotal movement that can take place between the operating arm and the frame includes a projection of the operating arm that extends through an elongate slot formed through the relatively flat base portion of the frame to define the stop engageable formation, and wherein the first and second stop formations are defined by opposed end regions of the elongate slot.

15. The latch assembly of claim 14 wherein the projection of the operating arm carries a shutter element for at least partially closing the elongate opening to the passage of foreign matter therethrough.

16. The latch assembly of claim 11 wherein the biasing means includes a torsion spring having a coiled central region that extends about said axis, a first end region that engages a selected one of the first and second arms of the frame, and a second end region that engages the latch arm for biasing the latch arm to pivot about said axis in said opposite direction of rotation.

17. The latch assembly of claim 11 wherein the means for defining a point of connection includes a linkage connection hole formed through relatively flat central region of the operating arm at a distance spaced from the pivot axis, and means for extending through the connection hole to establish a pivotal connection with a link that connects the operating arm to a device located at a distance spaced from the latch assembly.

18. The latch assembly of claim 17 in combination with another latch assembly, wherein the link connects the latch assemblies so as to be substantially concurrently unlatched.

19. The latch assembly of claim 17 in combination with a remotely located operating assembly having an operator-engageable element that can be moved from a normal position to an operated position, and wherein the link connects the latch assembly with the operating assembly so as to effect unlatching of the latch assembly in response to movement of the operator-engageable element from the normal position to the operated position.

20. The latch assembly of claim 11 wherein the first and second arms have dog-legged configurations that serve to define the striker receiving channel at a location spaced from the first plane, and wherein the latch arm has a dog-legged configuration that positions the hook-shaped formation to closely overlie a selected one of the first and second arms as the hook-shaped formation moves between latched and unlatched positions.

21. A flush mountable handle operable latch assembly for releasably retainingly engaging a striker, comprising:

a) a relatively shallow pan-shaped housing having a relatively flat back wall portion located at the rear of a forwardly facing recess that is surrounded by a rim that extends in a plane that substantially parallels a plane of the relatively flat back wall portion, with an opening formed through the back wall portion;

b) a handle configured to normally be substantially nested within the recess, and being connected to the housing for pivotal movement between a normal nested position and an operated position;

c) a frame connected to the housing and having a relatively flat base portion that overlies the relatively flat back wall portion and extends within a first plane that substantially parallels the plane of the back wall portion, wherein the frame also has a pair of formations that extend away from the base portion in a plane that substantially parallels the first plane to define first and second arms that define a striker receiving channel between opposed portions of the first and second arms;

d) means for defining a generally cylindrical mounting pin that is connected to and extends away from the flat base portion along an axis that is substantially perpendicular to the first plane;

e) an operating arm formed as a one-piece stamping from sheet metal and having a relatively flat central region positioned to closely overlie the relatively flat base portion of the frame, with a hole being formed through the relatively flat central region through which the mounting pin extends to connect the operating arm and the frame for relative pivotal movement about said axis;

f) means for defining a limited range of permitted relative pivotal movement that can take place between the operating arm and the frame including a first stop formation defined by a selected one of the frame and the back wall portion, a second stop formation defined by a chosen one of the frame and the back wall portion, and a stop engageable formation defined by the operating arm for engaging the first stop formation at one end of said range of movement, and to engage the second stop formation at the other end of said range of movement;

g) means for establishing a driving connection between the operating handle and the operating arm for pivoting the operating in one direction of movement in response to movement of the operating handle from the nested position to the operated position;

h) a latch arm formed as a one-piece stamping from sheet metal and having a relatively flat portion positioned to closely overlie the relatively flat central region of the operating arm, with a hole being formed through the relatively flat portion through which the mounting pin extends to connect the latch arm and the frame for relative pivotal movement about said axis, with the latch arm defining a hook-shaped formation at a location spaced from said axis, with the hook-shaped formation having a first surface configured to be engaged by a striker that is moving along a path of travel into the striker receiving channel to cause pivotal movement of the latch arm in said one direction of rotation about said axis to pivot the hook-shaped formation out of said path of travel, and with the hook-shaped formation also having a second surface configured to retain the striker within the striker receiving channel once the hook-shaped formation has pivoted in a direction of rotation opposite to said one direction to position the second surface to block withdrawal of the striker from the channel;

i) means for permitting the latch arm to move in said one direction of rotation without causing corresponding pivotal movement of the operating arm in said one direction to thereby enable a striker to be moved rapidly into the striker receiving channel and into latched engagement with the latch assembly without causing pivotal movement of the operating arm if the striker engages the first surface and thereby causes the latch arm to pivot out of the path of travel followed by the striker in moving into the striker receiving channel;

j) biasing means for biasing the latch arm to apply torque thereto for pivoting the latch arm in said opposite direction of rotation, and for utilizing the lost motion connection means to transfer from the latch arm to the operating arm said torque applied by the biasing means to pivot the operating arm in said opposite direction and to thereby bias the stop engageable formation toward engagement with the second stop formation; and, k) means for defining on the operating arm at a location spaced from said axis at least one connection formation for receiving an application of torque to the operating arm for rotating the operating arm in said one direction of rotation to drive the latch arm in said one direction of rotation to pivot the hook-shaped formation of the latch arm to position the second surface so that it does not block withdrawal of the striker from the striker receiving channel to thereby unlatch the latch mechanism from retainingly engaging the striker.

22. The latch assembly of claim 21 wherein at least one of the first and second arms has an end region configured to guide into the striker receiving channel a striker that is moving toward but not in perfect alignment with the striker receiving channel.

23. The latch assembly of claim 21 wherein the means for defining a generally cylindrical mounting pin is a headed pin that is connected at one end to the relatively flat central region of the frame, and that defines near the opposite end thereof a head formation having a shoulder configured to closely overlie the relatively flat portion of the latch arm.

24. The latch assembly of claim 21 wherein the means for defining a limited range of relative pivotal movement that can take place between the operating arm and the frame includes a projection of the operating arm that extends through at least one elongate slot formed through at least a selected one of 1) the relatively flat base portion of the frame and 2) the flat back wall portion of the housing to define the stop engageable formation, and wherein the first and second stop formations are defined by opposed end regions of the elongate slot.

25. The latch assembly of claim 24 wherein the projection of the operating arm carries a shutter element for at least partially closing the elongate opening to the passage of foreign matter therethrough.

26. The latch assembly of claim 21 wherein the biasing means includes a torsion spring having a coiled central region that extends about said axis, a first end region that engages a selected one of the first and second arms of the frame, and a second end region that engages the latch arm for biasing the latch arm to pivot about said axis in said opposite direction of rotation.

27. The latch assembly of claim 21 wherein the means for defining a point of connection includes a linkage connection hole formed through relatively flat central region of the operating arm at a distance spaced from the pivot axis, and means for extending through the connection hole to establish a pivotal connection with a link that connects the operating arm to a device located at a distance spaced from the latch assembly.

28. The latch assembly of claim 27 in combination with another latch assembly, wherein the link connects the latch assemblies so as to be substantially concurrently unlatched.

29. The latch assembly of claim 27 in combination with a remotely located operating assembly having an operator-engageable element that can be moved from a normal position to an operated position, and wherein the link connects the latch assembly with the operating assembly so as to effect unlatching of the latch assembly in response to movement of the operator-engageable element from the normal position to the operated position.

30. The latch assembly of claim 21 wherein the first and second arms have dog-legged configurations that serve to define the striker receiving channel at a location spaced from the first plane, and wherein the latch arm has a dog-legged configuration that positions the hook-shaped formation to closely overlie a selected one of the first and second arms as the hook-shaped formation moves between latched and unlatched positions.

31. The latch assembly of claim 21 wherein the housing is provided with a rearwardly facing recess that opens toward the frame, and the frame is provided with a forwardly facing projection that extends into the recess to engage the housing to assist in establishing a rigid connection between the frame and the housing.

32. A latch system for releasably latchingly engaging a striker, comprising:

a) an operating assembly having an operating member that is movable from a normal position to an operated position;

b) a latch assembly having an operating arm that can be moved from a first position to a second position to unlatch the latch assembly from a striker;

c) means for establishing a driving connection between the operating member and the operating arm for causing the operating arm to move from the first position to the second position in response to movement of the operating member from the normal position to the operated position;

d) wherein the latch assembly includes:

i) a frame formed as a one-piece stamping from sheet metal and having a relatively flat base portion that extends within a first plane, a pair of formations that extend away from the base portion in a plane that substantially parallels the first plane to define first and second arms that define a striker receiving channel between opposed portions of the first and second arms;

ii) means for defining a generally cylindrical mounting pin that is connected to and extends away from the flat base portion along an axis that is substantially perpendicular to the first plane;

iii) an operating arm formed as a one-piece stamping from sheet metal and having a relatively flat central region positioned to closely overlie the relatively flat base portion of the frame, with a hole being formed through the relatively flat central region through which the mounting pin extends to connect the operating arm and the frame for relative pivotal movement about said axis;

iv) means for defining a limited range of permitted relative pivotal movement that can take place between the operating arm and the frame including first and second spaced-apart stop formations defined by a selected one of the frame and the operating arm, and a stop engageable formation defined by the other of the frame and the operating arm that is configured to engage the first stop formation at one end of said range of movement, and to engage the second stop formation at the other end of said range of movement;

v) a latch arm formed as a one-piece stamping from sheet metal and having a relatively flat portion positioned to closely overlie the relatively flat central region of the operating arm, with a hole being formed through the relatively flat portion through which the mounting pin extends to connect the latch arm and the frame for relative pivotal movement about said axis, with the latch arm defining a hook-shaped formation at a location spaced from said axis, with the hook-shaped formation having a first surface configured to be engaged by a striker that is moving along a path of travel into the striker receiving channel to cause pivotal movement of the latch arm in one direction of rotation about said axis to pivot the hook-shaped formation out of said path of travel, and with the hook-shaped formation also having a second surface configured to retain the striker within the striker receiving channel once the hook-shaped formation has pivoted in a direction of rotation opposite to said one direction to position the second surface to block withdrawal of the striker from the channel;

vi) means for permitting the latch arm to move in said one direction of rotation without causing corresponding pivotal movement of the operating arm in said one direction to thereby enable a striker to be moved rapidly into the striker receiving channel and into latched engagement with the latch assembly without causing pivotal movement of the operating arm if the striker engages the first surface and thereby causes the latch arm to pivot out of the path of travel followed by the striker in moving into the striker receiving channel;

vii) biasing means for biasing the latch arm to apply torque thereto for pivoting the latch arm in said opposite direction of rotation, and for utilizing the lost motion connection means to transfer from the latch arm to the operating arm said torque applied by the biasing means to pivot the operating arm in said opposite direction and to thereby bias the stop engageable formation toward engagement with the second stop formation; and, viii) means for defining on the operating arm at a location spaced from said axis at least one connection formation for receiving an application of torque to the operating arm for rotating the operating arm in said one direction of rotation to drive the latch arm in said one direction of rotation to pivot the hook-shaped formation of the latch arm to position the second surface so that it does not block withdrawal of the striker from the striker receiving channel to thereby unlatch the latch mechanism from retainingly engaging the striker.

33. The latch assembly of claim 32 wherein at least one of the first and second arms has an end region configured to guide into the striker receiving channel a striker that is moving toward but not into perfect alignment with the striker receiving channel.

34. The latch assembly of claim 32 wherein the means for defining a generally cylindrical mounting pin is a headed pin that is connected at one end to the relatively flat central region of the frame, and that defines near the opposite end thereof a head formation having a shoulder configured to closely overlie the relatively flat portion of the latch arm.

35. The latch assembly of claim 32 wherein the means for defining a limited range of relative pivotal movement that can take place between the operating arm and the frame includes a projection of the operating arm that extends through at least one elongate slot formed through at least a selected one of 1) the relatively flat base portion of the frame and 2) the flat back wall portion of the housing to define the stop engageable formation, and wherein the first and second stop formations are defined by opposed end regions of the elongate slot.

36. The latch assembly of claim 35 wherein the projection of the operating arm carries a shutter element for at least partially closing the elongate opening to the passage of foreign matter therethrough.

37. The latch assembly of claim 32 wherein the biasing means includes a torsion spring having a coiled central region that extends about said axis, a first end region that engages a selected one of the first and second arms of the frame, and a second end region that engages the latch arm for biasing the latch arm to pivot about said axis in said opposite direction of rotation.

38. The latch assembly of claim 32 wherein the means for defining a point of connection includes a linkage connection hole formed through relatively flat central region of the operating arm at a distance spaced from the pivot axis, and means for extending through the connection hole to establish a pivotal connection with a link that connects the operating arm to a device located at a distance spaced from the latch assembly.

39. The latch assembly of claim 38 in combination with another latch assembly, wherein the link connects the latch assemblies so as to be substantially concurrently unlatched.

40. The latch assembly of claim 38 in combination with a remotely located operating assembly having an operator-engageable element that can be moved from a normal position to an operated position, and wherein the link connects the latch assembly with the operating assembly so as to effect unlatching of the latch assembly in response to movement of the operator-engageable element from the normal position to the operated position.

41. The latch assembly of claim 32 wherein the first and second arms have dog-legged configurations that serve to define the striker receiving channel at a location spaced from the first plane, and wherein the latch arm has a dog-legged configuration that positions the hook-shaped formation to closely overlie a selected one of the first and second arms as the hook-shaped formation moves between latched and unlatched positions.

* * * * *